US011164494B1

(12) United States Patent
Hashimoto

(10) Patent No.: US 11,164,494 B1
(45) Date of Patent: Nov. 2, 2021

(54) PIXEL CIRCUIT, DISPLAY DEVICE AND DETECTING METHOD

(71) Applicant: Innolux Corporation, Miao-Li County (TW)

(72) Inventor: Kazuyuki Hashimoto, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 0 days.

(21) Appl. No.: 17/084,636

(22) Filed: Oct. 30, 2020

(51) Int. Cl.
*G09G 3/00* (2006.01)
*G09G 3/32* (2016.01)

(52) U.S. Cl.
CPC ..... *G09G 3/006* (2013.01); *G09G 3/32* (2013.01); *G09G 2310/0267* (2013.01); *G09G 2310/0275* (2013.01); *G09G 2310/0291* (2013.01)

(58) Field of Classification Search
CPC ... G09G 2310/0267; G09G 2310/0291; G09G 3/32; G09G 3/006; G09G 2310/0275
See application file for complete search history.

(56) References Cited

U.S. PATENT DOCUMENTS

2006/0120357 A1* 6/2006 Kawasaki ..... G09G 3/325 370/354
2010/0225634 A1* 9/2010 Levey ..... G09G 3/3208 345/212
2015/0379940 A1* 12/2015 Kishi ..... G09G 3/3283 345/690
2016/0148578 A1* 5/2016 Kishi ..... G09G 3/3291 345/212
2019/0012948 A1* 1/2019 Ohara ..... G09G 3/3233

FOREIGN PATENT DOCUMENTS

CN 101164377 4/2008
CN 107293239 10/2017

* cited by examiner

*Primary Examiner* — Muhammad N Edun
(74) *Attorney, Agent, or Firm* — JCIPRNET

(57) ABSTRACT

A pixel circuit is provided. The pixel circuit includes a first transistor, a second transistor, a third transistor, and a light emitting unit. The second transistor is coupled to the first transistor. The third transistor is coupled to the second transistor. The light emitting unit is coupled to the first transistor. When the first transistor is turned off, a current of a node between the third transistor and the first transistor is detected.

18 Claims, 24 Drawing Sheets

PIXEL CIRCUIT, DISPLAY DEVICE AND DETECTING METHOD

BACKGROUND

1. Technical Field

The disclosure generally relates to a circuit, a device and a method, in particular, to a pixel circuit and a display device of a light-emitting diode (LED) and a detecting method.

2. Description of Related Art

Image non-uniformity which caused by an LED driving circuit has been a problem. The image non-uniformity is caused by TFT variation in manufacturing the LED display device, and further leads to, for example, the mura effect. Therefore, there is necessity to improve the above problem.

SUMMARY

Accordingly, the disclosure is directed to a pixel circuit, a display device and a detecting method that a current monitoring function and/or a voltage monitoring function are provided.

The pixel circuit of the disclosure includes a first transistor, a second transistor, a third transistor, and a light emitting unit. The second transistor is coupled to the first transistor. The third transistor is coupled to the second transistor. The light emitting unit is coupled to the first transistor. When the first transistor is turned off, a current of a node between the third transistor and the first transistor is detected.

The detecting method of the disclosure is adapted to detect a pixel circuit. The detecting method includes providing a first transistor and a light emitting unit in the pixel circuit, wherein the light emitting unit is coupled to the first transistor; providing a second transistor and a third transistor, wherein the second transistor is coupled to a node between the third transistor and the first transistor in the pixel circuit; and detecting a current of the node between the third transistor and the first transistor when the first transistor is turned off.

The display device of the disclosure includes a plurality of pixel circuits. At least one of the plurality of pixel circuits includes a first transistor, a second transistor, a third transistor, and a light emitting unit. The second transistor is coupled to the first transistor. The third transistor is coupled to the second transistor. The light emitting unit is coupled to the first transistor. When the first transistor is turned off, a current of a node between the third transistor and the first transistor is detected.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1A:
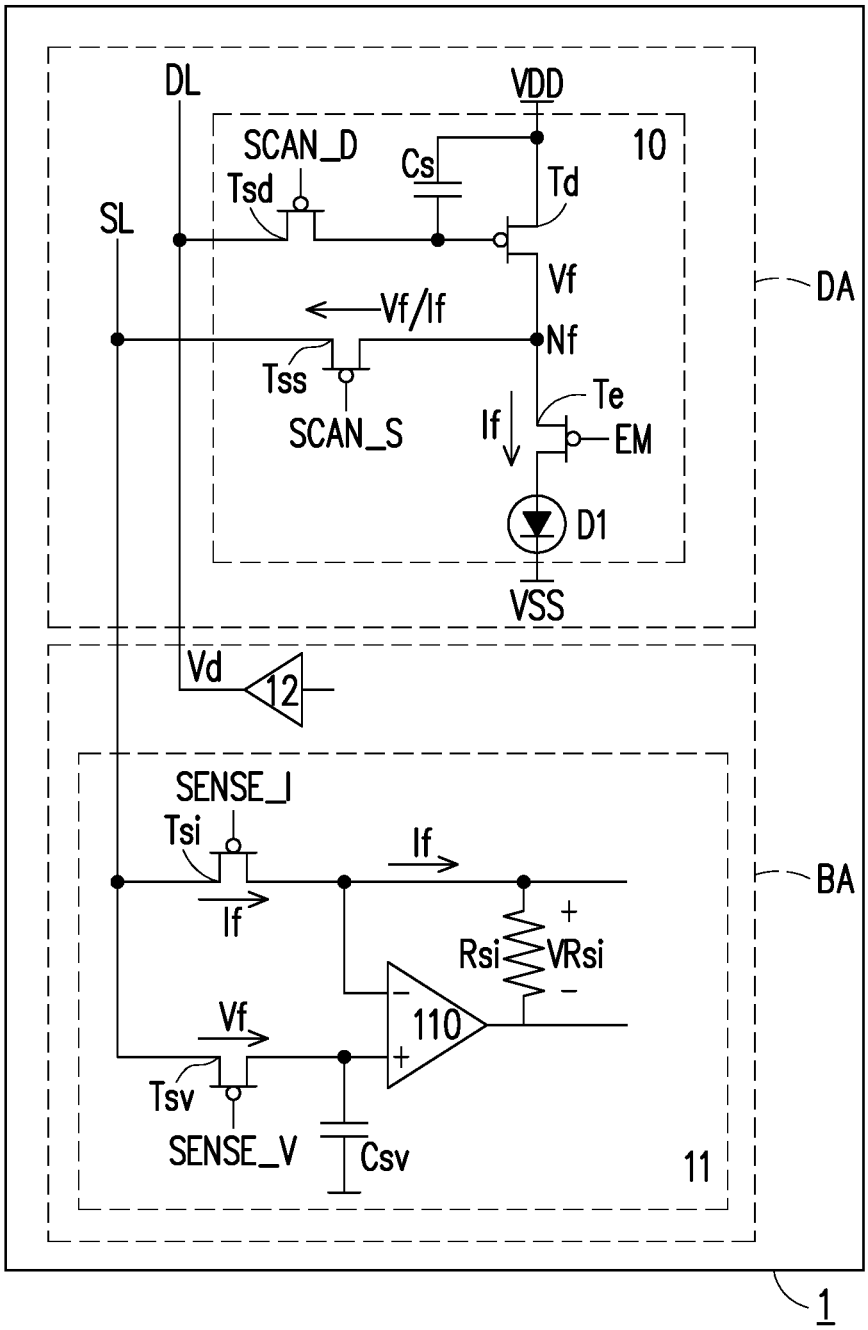
FIG. 1A is a schematic diagram of a display device according to an embodiment of the disclosure.

The following embodiments when read with the accompanying drawings are made to clearly exhibit the above-mentioned and other technical contents, features and/or effects of the present disclosure. Through the exposition by means of the specific embodiments, people would further understand the technical means and effects the present disclosure adopts to achieve the above-indicated objectives. Moreover, as the contents disclosed herein should be readily understood and can be implemented by a person skilled in the art, all equivalent changes or modifications which do not depart from the concept of the present disclosure should be encompassed by the appended claims.

Certain terms are used throughout the description and following claims to refer to particular components. As one skilled in the art will understand, electronic equipment manufacturers may refer to a component by different names. This document does not intend to distinguish between components that differ in name but not function.

In the following description and in the claims, the terms "include", "comprise" and "have" are used in an open-ended fashion, and thus should be interpreted to mean "include, but not limited to . . . ".

It will be understood that when an element or layer is referred to as being "on" or "connected to" another element or layer, it can be directly on or directly connected to the other element or layer, or intervening elements or layers may be presented. In contrast, when an element is referred to as being "directly on" or "directly connected to" another element or layer, there are no intervening elements or layers presented.

It should be understood that, although the terms first, second, third etc. may be used herein to describe various elements, components, regions, layers, portions and/or sections, these elements, components, regions, layers, portions and/or sections should not be limited by these terms. These terms are only used to distinguish one element, component, region, layer, portion or section from another region, layer or section. Thus, a first element, component, region, layer, portion or section discussed below could be termed a second element, component, region, layer, portion or section without departing from the teachings of the present disclosure.

The terms "about" and "substantially" typically mean+/−10% of the stated value, more typically +/−5% of the stated value, more typically +/−3% of the stated value, more typically +/−2% of the stated value, more typically +/−1% of the stated value and even more typically +/−0.5% of the stated value. The stated value of the present disclosure is an approximate value. When there is no specific description, the stated value includes the meaning of "about" or "substantially."

Furthermore, the terms recited in the specification and the claims such as "connect" or "couple" is intended not only directly connect with other element, but also intended indirectly connect and electrically connect with other element.

In addition, the features in different embodiments of the present disclosure can be mixed to form another embodiment.

In exemplary embodiments of the disclosure, an LED current monitoring function is provided for the LED display device and a back-light module, which can contribute to improve image non-uniformity caused by the LED driving circuit. In addition, an LED voltage monitoring function is also provided, which can contribute to improve efficiency in test, analysis and characterization of the LED display device and its driving system with the current monitoring data. The following disclosure provides many different embodiments, or examples, for implementing different features of the disclosure. Specific examples of components and arrangements are described below to simplify the disclosure. These are, of course, merely examples and are not intended to be limiting.

FIG. 1A is a schematic diagram of a display device 1 according to an embodiment of the disclosure. The display device 1 has a display area DA and a border area BA, and the border area BA is disposed outside the display area DA. The display device 1 includes a plurality of pixels circuits 10 and a plurality of current monitors 11. FIG. 1A only shows one of the plurality of pixels circuits 10 and one of the plurality of current monitors 11 for simplicity. The pixel circuit 10 can be disposed in the display area DA, and the current monitor 11 can be disposed in the border area BA.

The pixel circuit 10 includes a first transistor Te, a switch transistor Tss (i.e. the second transistor), a driving transistor Td (i.e. the third transistor), a fourth transistor Tsd, a light emitting unit D1, and a capacitor Cs. The driving transistor Td is coupled to the switch transistor Tss. The first transistor Te is coupled to the switch transistor Tss. The fourth transistor Tsd is coupled to the driving transistor Td. The light emitting unit D1 is coupled to the first transistor Te. The capacitor Cs is coupled to the driving transistor Td. When the first transistor Te is turned off, a current If of a node Nf between the driving transistor Td and the first transistor Te is detected. When the first transistor Te is turned on, a voltage Vf of the node Nf between the driving transistor Td and the first transistor Te is detected. Specifically, the pixel circuit 10 is coupled to a current monitor 11, which detects the current If of the node Nf. In some embodiments, the current monitor 11 also detects the voltage Vf of the node Nf.

In one embodiment, the current monitor 11 may be disposed in the border area BA of the display device 1. There may be one or more pixel circuits 10 connected to the same sense line SL, and the current monitor 11 may detect the voltage Vf and/or the current If of the pixel circuits 10 connected to the same sense line SL.

Referring to FIG. 1A, in detail, the driving transistor Td has a first end receiving a first reference voltage VDD, a second end coupled to the node Nf, a control end coupled to the fourth transistor Tsd. The first transistor Te has a first end coupled to the node Nf, a second end coupled to the light emitting unit D1, and a control end receiving an emission signal EM. The light emitting unit D1 has a first end coupled to the second end of the first transistor Te and a second end receiving the second reference voltage VSS. The fourth transistor Tsd has a first end coupled to a data line DL, a second end coupled to the control end of the driving transistor Td. and a control end receiving a first scan signal SCAN_D. The switch transistor Tss has a first end coupled to a sense line SL, a second end coupled to the node Nf and a control end receiving a second scan signal SCAN_S. The capacitor Cs has a first end receiving the first reference voltage VDD and a second end coupled to the control end of the driving transistor Td. A data driver 12 is coupled to the data line DL for providing a data voltage Vd to the pixel circuit 10. As such, the driving transistor Td, the first transistor Te and the light emitting unit D1 are connected in series between the first reference voltage VDD and the second reference voltage VSS. The second transistor provides the data voltage Vd from the data line DL to the control end of the driving transistor Td. The switch transistor Tss outputs the current and/or the voltage Vf of the node Nf to the current monitor 11.

Referring to FIG. 1A, the current monitor 11 includes a first sensing transistor Tsv, a second sensing transistor Tsi, an operational amplifier 110, a resistor Rsi and a capacitor Csv. The first sensing transistor Tsv has a first end coupled to the first end of the switch transistor Tss through the sense line SL, a second end coupled to the operational amplifier 110, and a control end receiving a first sensing signal SENSE_V. The second sensing transistor Tsi has a first end coupled to the first end of the switch transistor Tss through the sense line SL, a second end coupled to the operational amplifier 110, and a control end receiving a second sensing signal SENSE_I. The operational amplifier 110 has a first input end coupled to the second end of the first sensing transistor Tsv, a second input end coupled to the second end of the second sensing transistor Tsi, and an output end generating an output signal. The resistor Rsi is connected between the second input end of the operational amplifier 110 and the output end of the operational amplifier 110. The capacitor Csv has a first end coupled to the first input end of the operational amplifier 110 and a second receiving the second reference voltage VSS.

In one embodiment, the driving transistor Td, the first transistor Te, the fourth transistor Tsd, and the switch transistor Tss are P-type metal-oxide-silicon (PMOS) transistors. The first sensing transistor Tsv and the second sensing transistor Tsi are PMOS transistors. However, the disclosure is not limited to the above, and persons having ordinary skill in the art can alter or replace one or more PMOS transistors in the pixel circuit 10 and the current monitor 11 by NMOS transistors or other suitable circuits, which are also within the scope of the disclosure.

Figure 1B:
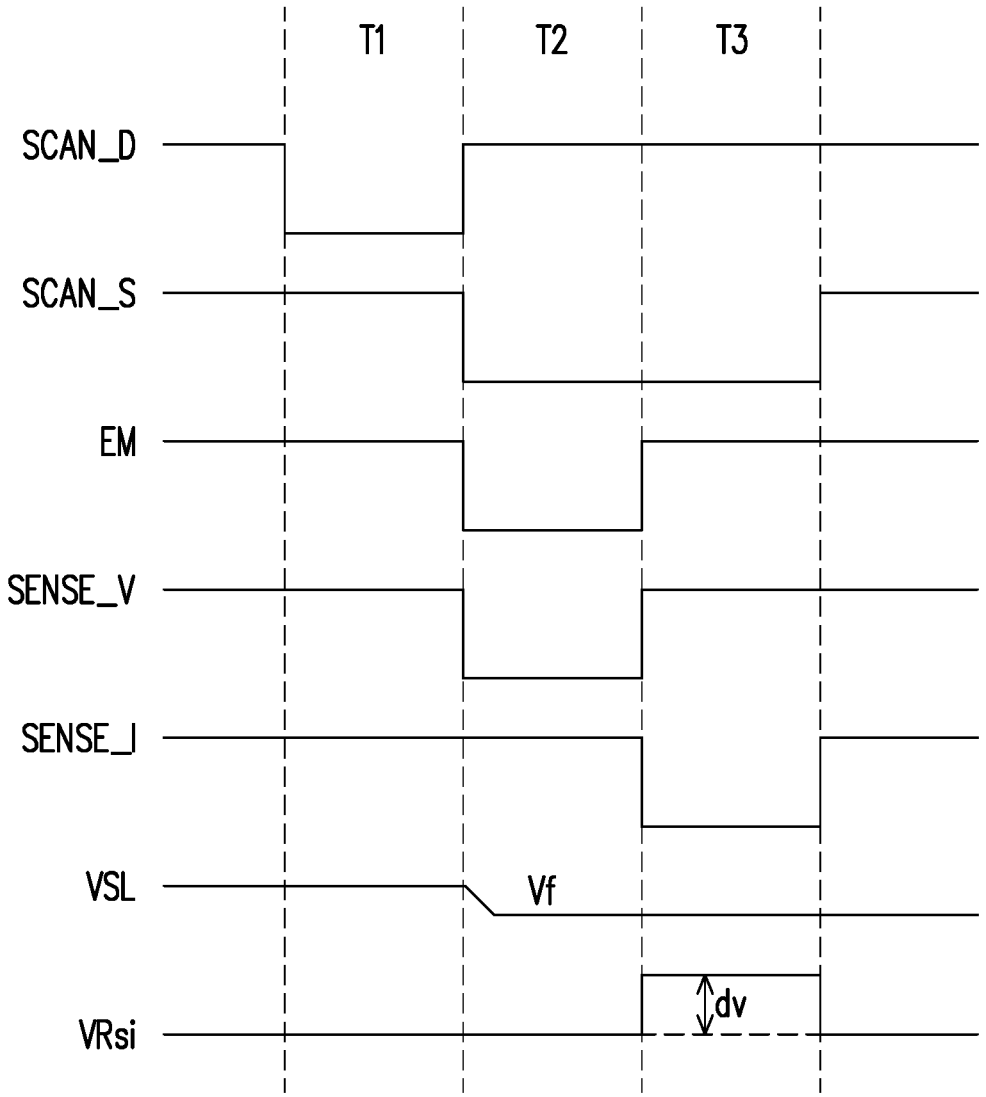
FIG. 1B is a schematic diagram showing operation waveforms of the display device illustrated in FIG. 1A according to an embodiment of the disclosure.

FIG. 1B is a schematic diagram showing operation waveforms of the display device 1 illustrated in FIG. 1A according to an embodiment of the disclosure. In this embodiment, the operation waveforms are illustrated under an exemplary embodiment that all the transistors in the pixel circuit 10 and the current monitor 11 are PMOS transistor, which should not be utilized for limiting the scope of the disclosure.

In a first time region T1, the first scan signal SCAN_D is switched from a high voltage level to a low voltage level, and thus the fourth transistor Tsd is turned on. The data voltage Vd provided from the data driver 12 is stored in the capacitor Cs through the data line DL and the fourth transistor Tsd.

In a second time region T2, the first scan signal SCAN_D is switched back to the high voltage level, the second scan signal SCAN_S, the emission signal EM and the first sensing signal SENSE_V are switched to the low voltage level. The fourth switch Tsd is turned off, the first transistor Te and the switch transistor Tss are turned on. Since the first transistor Te is turned on, the current If flows through the first transistor Te, and the light emitting unit D1 is driven by the driving transistor Td according to the data voltage Vd stored in the capacitor Cs. In addition, the corresponding voltage Vf at the node Nf is outputted to the sense line SL through conduction of the switch transistor Tss, and a voltage VSL of the sense line SL is changed to be the same as the voltage Vf of the node Nf. Moreover, since the first sensing transistor Tsv of the current monitor 11 is turned on, the voltage Vf is passed to the first input end of the operational amplifier 110 and stored by the capacitor Csv. As mentioned above, the voltage Vf of the node Nf can be detected in the second time region T2.

In a third time region T3, the second scan signal SCAN_S remains at the low voltage level, the emission signal EM and the first sensing signal SENSE_V are switched to the high voltage level, and the second sensing signal SENSE_I is switched to the low voltage level. Therefore, the first transistor Te is turned off and the switch transistor Tss remained turned on, and the current If originally flowing through the first transistor Te is currently redirected to be flown the sense line SL. Moreover, since the first sensing transistor Tsv is turned off and the second sensing transistor Tsi is turned on, the current If is guided to be flown through the resistor Rsi. Therefore, a voltage drop dV is correspondingly occurred on a voltage difference VRsi between both ends of the resistor Rsi, and amount of the current If can be obtained by dividing the voltage drop dV to a resistance of the resistor Rsi. As mentioned above, the current If of the node Nf can be detected in the third time region T3.

As a result, for one pixel circuit 10, by applying the aforementioned time regions T1-T3, the current If of the node Nf can be detected in the third time region T3. In some embodiments, the voltage Vf of the node Nf can be detected in the second time region T2, and the detected voltage Vf can be calculated to obtain the current If. By providing different data voltages Vd, the detected (or calculated) current If of the node Nf can be different. Referring to FIG. 11C, for one pixel circuit 10, by applying different data voltages Vd, a relationship recording a V-I curve of all data voltages Vd and the corresponding detected currents If can be obtained. Similarly, a plurality of relationships of V-I curves for a plurality of pixel circuits 10 in the display device 1 can be obtained. In addition, the plurality of V-I curves for the plurality pixel circuits 10 can be combined with another relationship between the LED driving current and the LED luminance, and thus, a plurality of lookup tables recording the plurality of relationships between the data voltages and the LED luminances for the plurality of pixel circuits 10 in the display device 1 can be obtained.

In some embodiments, according to the above-mentioned pixel circuit design the current detection way, the lookup tables recording the relationships between the data voltages and the LED luminances for all pixel circuits 10 in the display device 1 can be obtained. In this way, the calibration on the LED luminance can be performed based on the detected electrical property (for example, current or voltage) and based on the lookup tables. Thus, luminance non-uniformity or image non-uniformity issues of each pixel circuit can be effectively reduced, and mura effect of the display device can be reduced.

Figure 2A:
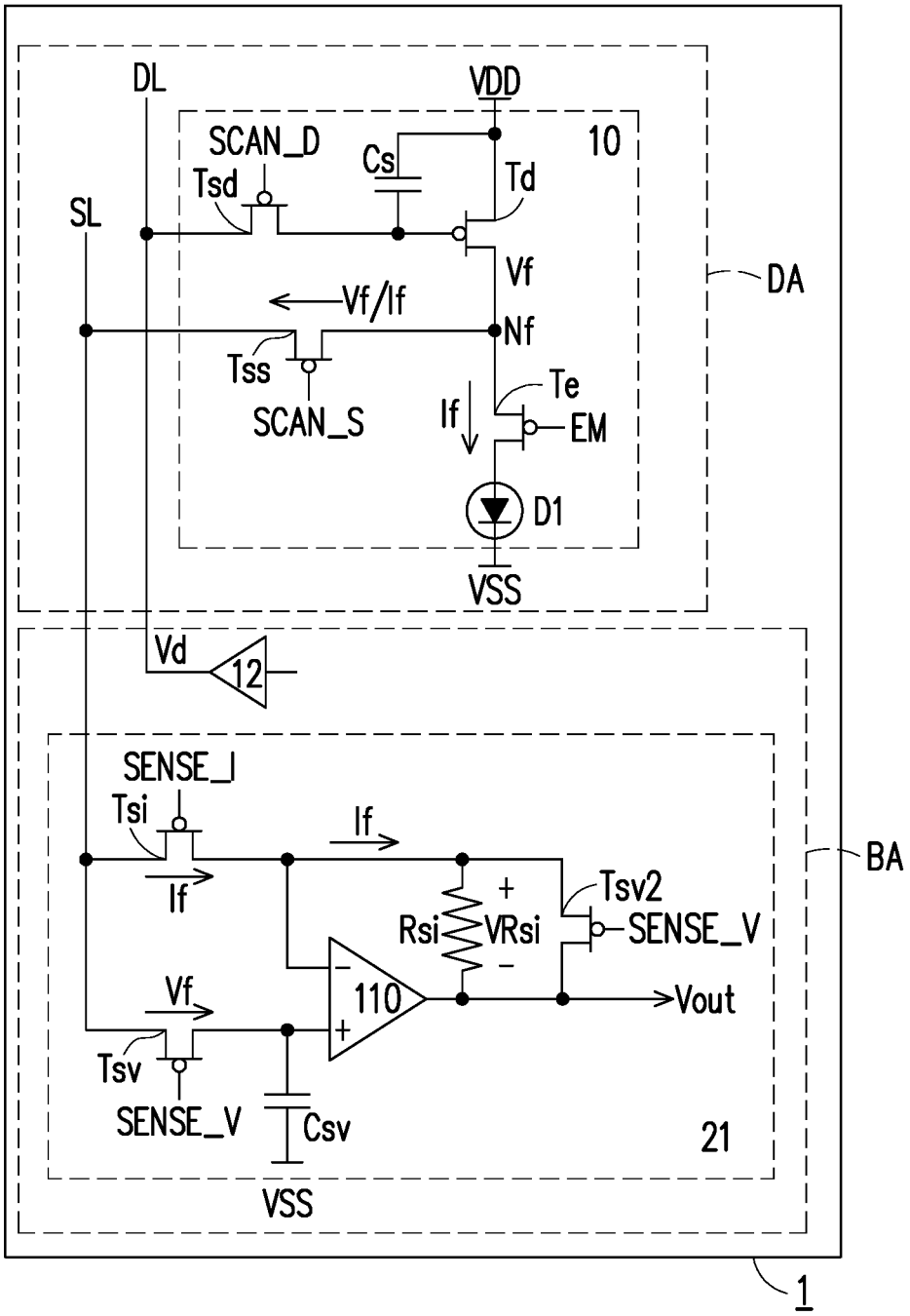
FIG. 2A is a schematic diagram of a display device according to an embodiment of the disclosure.

FIG. 2A is a schematic diagram of a display device 1 according to an embodiment of the disclosure. FIG. 2A is similar to FIG. 1A, except that the current monitor 11 in FIG. 1A is replaced by a current monitor 21 is in FIG. 2A.

Referring to FIG. 2A, specifically, the current monitor 21 includes a first sensing transistor Tsv, a second sensing transistor Tsi, a third sensing transistor Tsv2, an operational amplifier 110, a resistor Rsi, and a capacitor Csv. The first sensing transistor Tsv has a first end coupled to the first end of the switch transistor Tss through the sense line SL, a second end coupled to the operational amplifier 110, and a control end receiving a first sensing signal SENSE_V. The second sensing transistor Tsi has a first end coupled to the first end of the switch transistor Tss through the sense line SL, a second end coupled to the operational amplifier 110, and a control end receiving a second sensing signal SENSE_I. The operational amplifier 110 has a first input end coupled to the second end of the first sensing transistor Tsv, a second input end coupled to the second end of the second sensing transistor Tsi, and an output end for generating an output signal Vout. The resistor Rsi is connected between the second input end of the operational amplifier 110 and the output end of the operational amplifier 110. The capacitor Csv has a first end coupled to the first input end of the operational amplifier 110 and a second end receiving the second reference voltage VSS. The third sensing transistor Tsv2 is coupled in parallel to the resistor Rsi. The third sensing transistor Tsv2 has a first end coupled to the second input end of the operational amplifier 110, a second end coupled to the output end of the operational amplifier 110, and a control end receiving the first sensing signal SENSE_V.

Figure 2B:
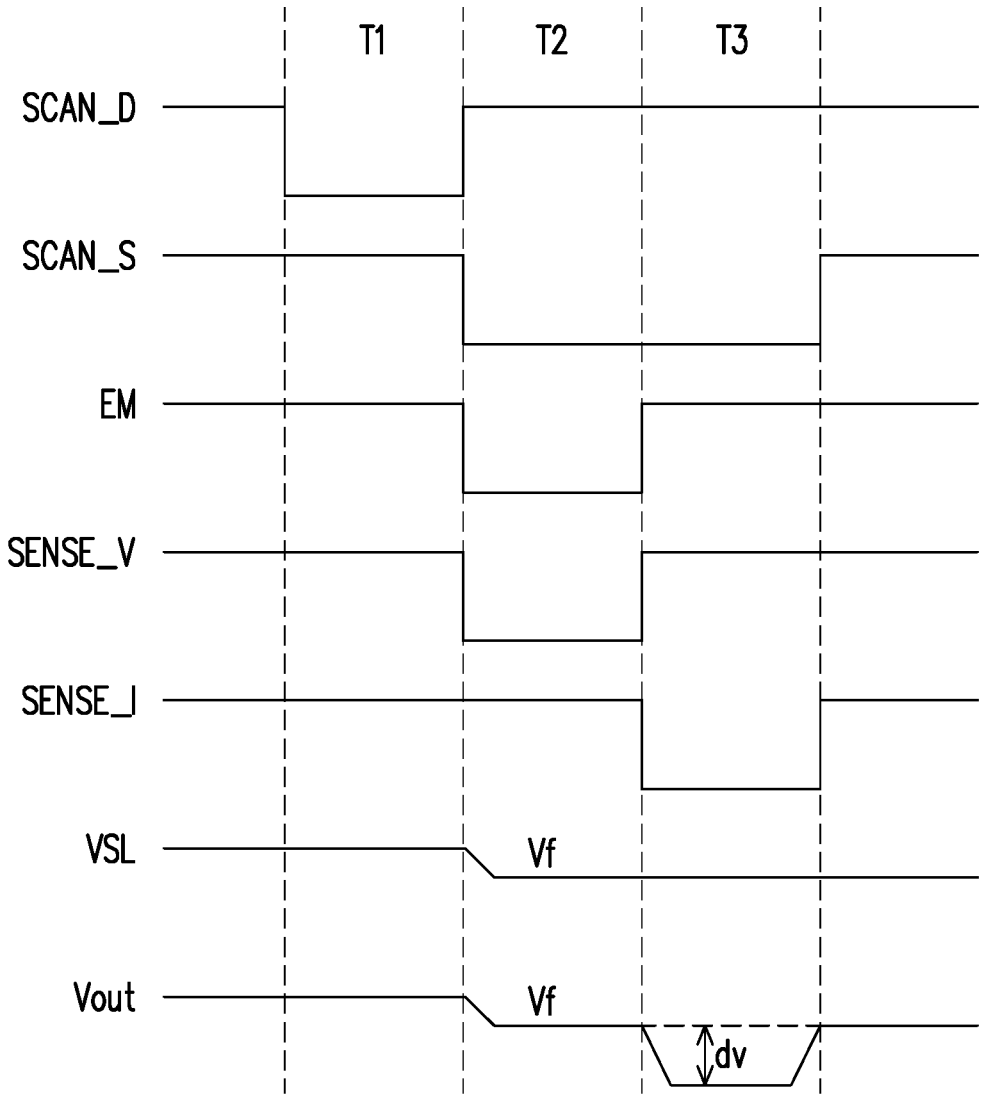
FIG. 2B is a schematic diagram showing operation waveforms of the pixel circuits and the current monitor illustrated in FIG. 2A according to an embodiment of the disclosure.

FIG. 2B is a schematic diagram showing operation waveforms of the display device 1 illustrated in FIG. 2A according to an embodiment of the disclosure.

In a first time region T1, the first scan signal SCAN_D is switched from a high voltage level to a low voltage level, and thus the fourth transistor Tsd is turned on. The data voltage Vd provided from the data driver 12 is stored in the capacitor Cs through the data line DL and the fourth transistor Tsd.

In a second time region T2, the first scan signal SCAN_D is switched to the high voltage level, the second scan signal SCAN_S, the emission signal EM and the first sensing signal SENSE_V are switched to the low voltage level. The fourth switch Tsd is turned off, the first transistor Te the switch transistor Tss, the first sensing transistor Tsv and the third sensing transistor Tsv2 are turned on. The voltage Vf is inputted to the first input end of the operational amplifier 110. Since the third sensing transistor Tsv2 is turned on, the output signal Vout is changed to be the same as the voltage Vf due to negative feedback.

In a third time region T3, the second scan signal SCAN_S remains at the low voltage level, the emission signal EM and the first sensing signal SENSE_V are switched to the high voltage level, and the second sensing signal SENSE_I is switched to the low voltage level. The first transistor Te and the first sensing transistor Tsv are turned off, the second sensing transistor Tsi is turned on. The current If is redirected to be flown through the resistor Rsi, and a voltage drop dV is correspondingly occurred in the output signal Vout. Therefore, the current If can be calculated by dividing the voltage drop dV to a resistance of the resistor Rsi.

In short, the current monitor 21 can obtain both the voltage Vf and the current If of the node Nf. An I-V curve between the voltage Vf to the current If may also be obtained. These additional information of the voltage Vf and the current If of the pixel circuit 10 is be beneficial while testing the display device with the pixel circuits 10 disposed and building characteristics of the pixel circuit 10. As a result, image non-uniformity, i.e. mura effect, of the pixel circuit 10 is improved.

Figure 3A:
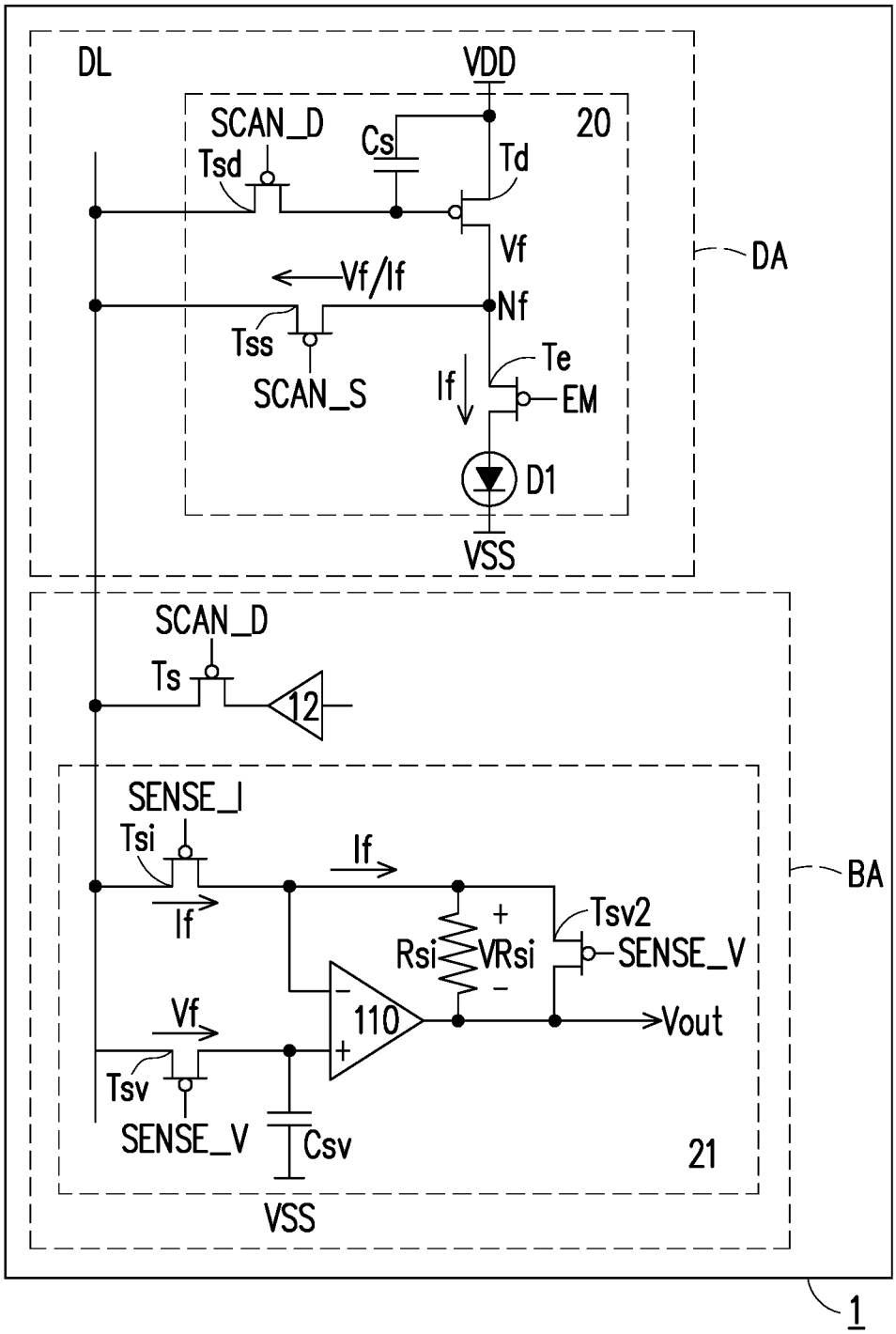
FIG. 3A is a schematic diagram of a display device according to an embodiment of the disclosure.

FIG. 3A is a schematic diagram of a display device 1 according to an embodiment of the disclosure. The display device 1 includes a pixel circuit 20 and a current monitor 21. The pixel circuit 20 includes a switch transistor Tss, a driving transistor Td, a first transistor Te, a fourth transistor Tsd, a light emitting unit D1, and a capacitor Cs. The driving transistor Td is coupled to the switch transistor Tss. The first transistor Te is coupled to the switch transistor Tss. The fourth transistor Tsd is coupled to the driving transistor Td. The light emitting unit D1 is coupled to the first transistor Te. The capacitor Cs is coupled to the driving transistor. When the first transistor Te is turned off, a current If of a node Nf between the driving transistor Td and the first transistor Te is detected. When the first transistor Te is turned on, a voltage Vf of the node Nf between the driving transistor Td and the first transistor Te is detected. Specifically, the pixel circuit 20 is coupled to a current monitor 21, which detects the current If of the node Nf. In some embodiments, the current monitor 21 also detects the voltage Vf of the node Nf.

Referring to FIG. 3A, in detail, the driving transistor Td has a first end receiving a first reference voltage VDD, a second end coupled to the node Nf, a control end coupled to the fourth transistor Tsd. The first transistor Te has a first end coupled to the node Nf, a second end coupled to the light emitting unit D1, and a control end receiving an emission signal EM. The light emitting unit D1 has a first end coupled to the second end of the first transistor Te and a second end receiving the second reference voltage VSS. The fourth transistor Tsd has a first end coupled to a data line DL, a second end coupled to the control end of the driving transistor Td, and a control end receiving a first scan signal SCAN_D. The switch transistor Tss has a first end coupled to the data line DL, a second end coupled to the node Nf and a control end receiving a second scan signal SCAN_S. The capacitor Cs has a first end receiving the first reference voltage VDD and a second end coupled to the control end of the driving transistor Td. A data driver 12 is coupled to the data line DL for providing a data voltage Vd to the pixel circuit 10. As such, the driving transistor Td, the first transistor Te and the light emitting unit D1 are connected in series between the first reference voltage VDD and the second reference voltage VSS. The fourth transistor Tsd provides the data voltage Vd from the data line DL to the control end of the driving transistor Td. The switch transistor Tss outputs the current If and/or the voltage Vf of the node Nf to the current monitor 21.

The current monitor 21 includes a first sensing transistor Tsv, a second sensing transistor Tsi, a third sensing transistor Tsv2, an operational amplifier 110, a resistor Rsi, and a capacitor Csv. Please refer to paragraphs related to FIG. 2A for details of the current monitor 21, which is omitted herein for simplicity. It is noted that the first end of the first sensing transistor Tsv and the first end of the second of the second sensing transistor Tsi are connected to the data line DL, instead of the sense line as illustrated in FIG. 2A.

Referring to FIG. 3A, specifically, the data line DL is coupled to the first end of the switch transistor Tss, the first end of the first sensing transistor Tsv, and the first end of the second transistor Tsi, such that the data line DL is utilized for transmitting data voltage Vd, the voltage Vf, and the current If. In order for the data voltage Vd, the voltage Vf and the current If to be able to be transmitted through the data line DL without interference, a fifth transistor Ts is disposed to be connected between the data line DL and the data driver 12 to isolate the data driver 12. Specifically, a first end of the fifth transistor Ts is connected to the data line DL, a second end of the fifth transistor I's is connected to the data driver 12, and a control end of the fifth transistor Ts receives the first scan signal SCAN_D. Therefore, with the aid of the fifth transistor Ts, the data voltage Vd, the voltage Vf, and the current If may be transmitted on the same data line DL.

Figure 3B:
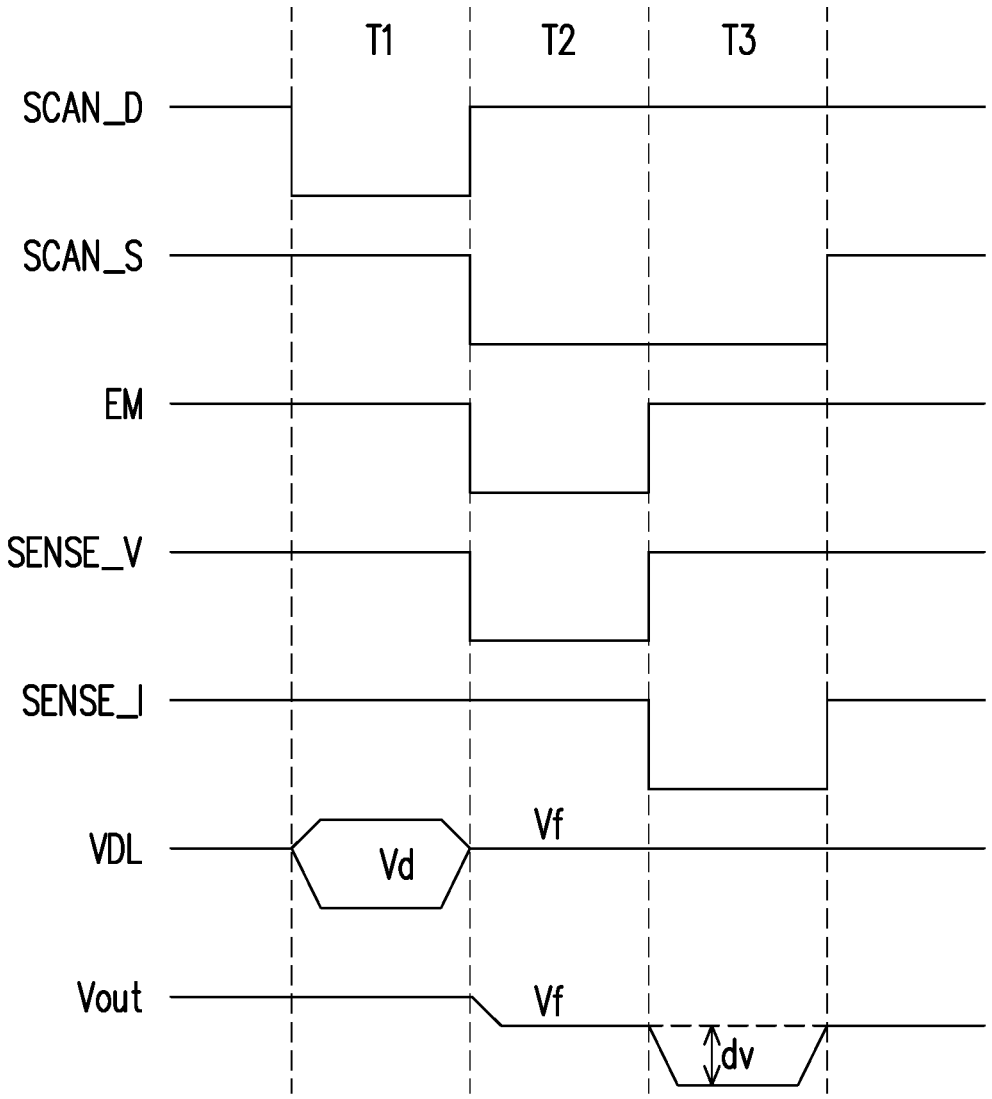
FIG. 3B is a schematic diagram showing operation waveforms of the display device illustrated in FIG. 3A according to an embodiment of the disclosure.

FIG. 3B is a schematic diagram showing operation waveforms of the display device 1 illustrated in FIG. 3A according to an embodiment of the disclosure.

In a first time region T1, the first scan signal SCAN_D is switched from a high voltage level to a low voltage level, and thus the fourth transistor Tsd and the fifth transistor Is are turned on. The data voltage Vd is provided from the data driver 12 to the data line DL, so that a voltage VDL of the data line DL carries the data voltage Vd and is stored by the capacitor Cs during the first time region T1.

In a second time region T2, the first scan signal SCAN_D is switched to the high voltage level, the second scan signal SCAN_S, the emission signal EM and the first sensing signal SENSE_V are switched to the low voltage level. The fourth switch Tsd is turned off, the first transistor Te, the switch transistor Tss, the first sensing transistor Tsv and the third sensing transistor Tsv2 are turned on. The output signal Vout is changed to be the same as the voltage Vf due to negative feedback. In addition, since the voltage Vf is transmitted through the data line DL, the voltage VDL of the data line is changed to be the same as the voltage Vf.

In a third time region T3, the second scan signal SCAN_S remains at the low voltage level, the emission signal EM and the first sensing signal SENSE_V are switched to the high voltage level, and the second sensing signal SENSE_I is switched to the low voltage level. The current If is guided to be flown through the resistor Rsi, and resulted in a voltage drop dV to be correspondingly occurred in the output signal Vout. Therefore, the current If can be calculated by dividing the voltage drop dV to a resistance of the resistor Rsi.

In short, since the data line DL can be utilized for transmitting the data voltage Vd, the voltage Vf, and the current If, chip area, manufacturing cost, and routing complexity of the pixel circuit 20 and the current monitor 21 can be effectively reduced.

Figure 4A:
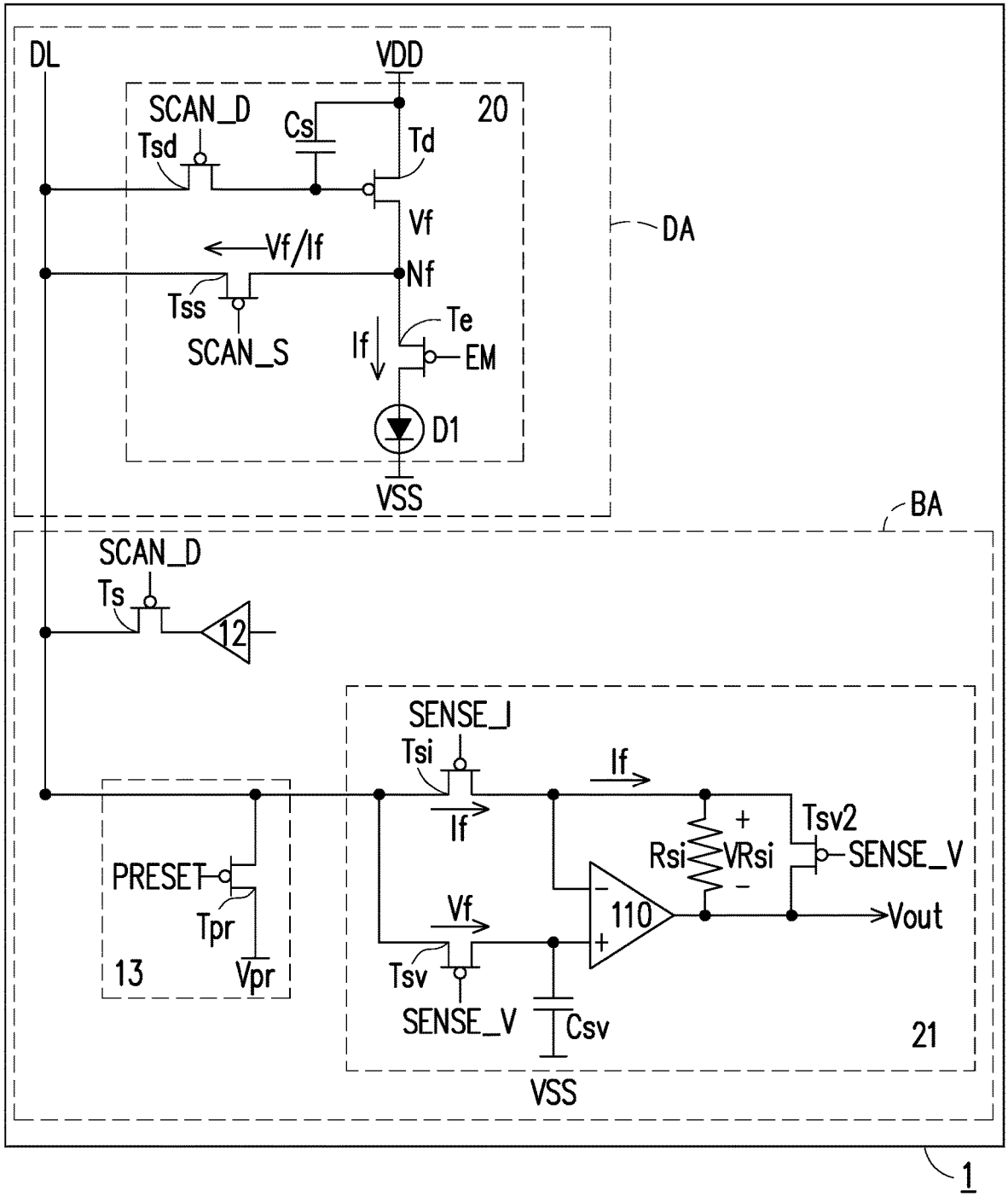
FIG. 4A is a schematic diagram of a display device according to an embodiment of the disclosure.

FIG. 4A is a schematic diagram of a display device 1 according to an embodiment of the disclosure. FIG. 4A is similar to FIG. 3A, except that in FIG. 4A, there is a preset circuit 13 arranged to be connected the data line DL. In one embodiment, the preset circuit 13 along with the current monitor 21 may be disposed in the border area BA to preset voltages of the data line DL.

The preset circuit 13 is coupled between the data line DL and a preset voltage Vpr. The preset circuit 13 is controlled by a preset signal PRESET to determine whether to provide the preset voltage Vpr to the data line DL. In one embodiment, the preset circuit 13 may be a PMOS transistor Tpr which has a first end coupled to the data line DL, a second end receiving the preset voltage Vpr, and a control end receiving the preset signal PRESET.

Figure 4B:
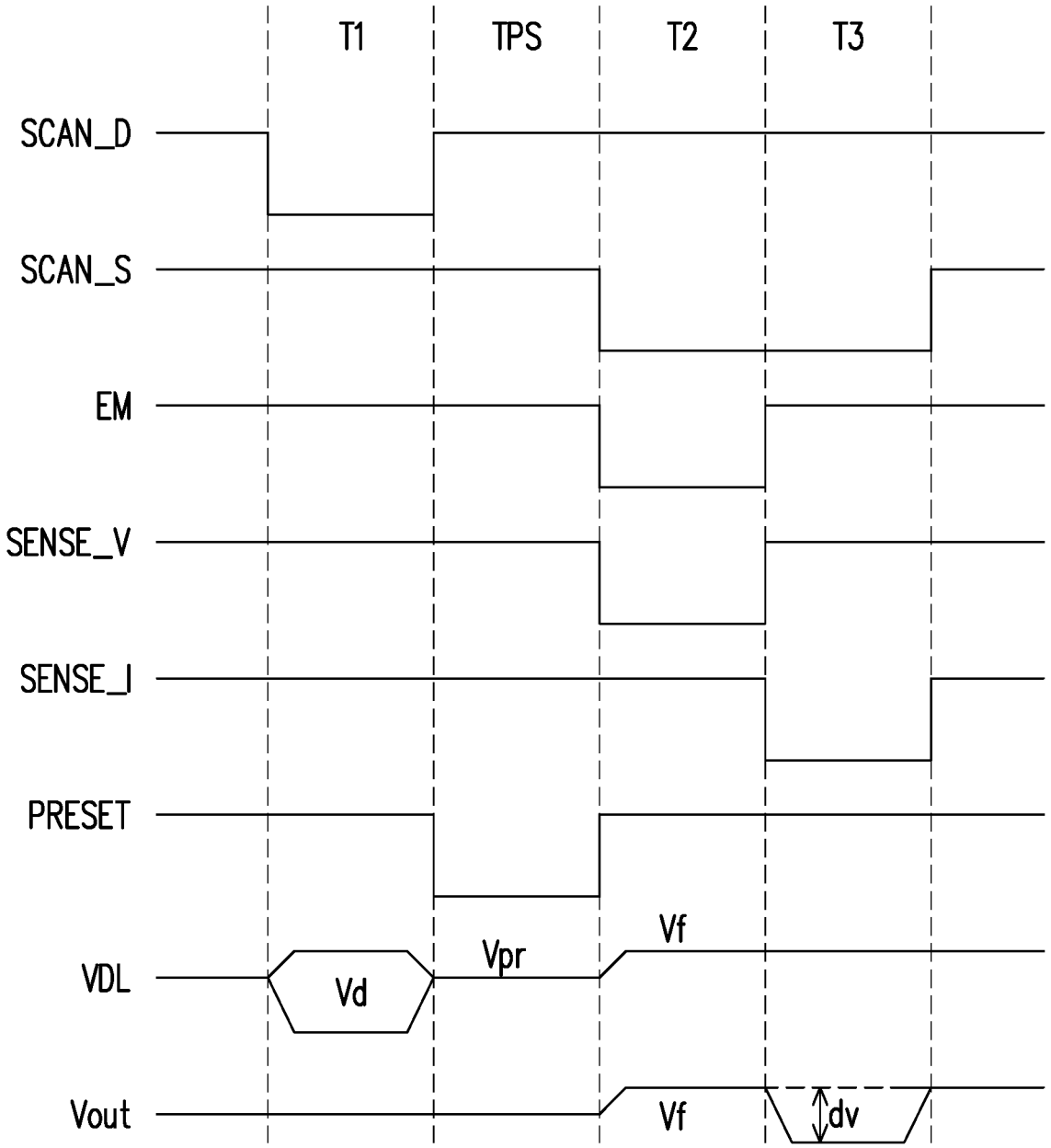
FIG. 4B is a schematic diagram showing operation waveforms of the display device illustrated in FIG. 4A according to an embodiment of the disclosure.

FIG. 4B is a schematic diagram showing operation waveforms of the display device 1 illustrated in FIG. 4A according to an embodiment of the disclosure. FIG. 4B is similar to FIG. 3B, except that there is a preset time region TPS arranged between the first time region T1 and the second time region T2.

In a first time region T1, the first scan signal SCAN_D is switched from a high voltage level to a low voltage level, and thus the fourth transistor Tsd and the fifth transistor I's are turned on. The data voltage Vd is provided from the data driver 12 to the data line DL, so that a voltage VDL of the data line DL carries the data voltage Vd and is stored by the capacitor Cs during the first time region T1.

Referring to FIG. 4B, in a preset time region TPS, the first scan signal SCAN_D is switched from the low voltage level to the high voltage level, and the preset signal PRESET is switched from the high voltage level to the low voltage level. The fourth transistor Tsd and the fifth transistor Ts are turned off, and preset circuit 13 is enabled to provide the preset voltage Vpr to the data line DL. Accordingly, the voltage VDL of the data line DL is changed to be the same as the preset voltage Vpr.

In a second time region T2, the second scan signal SCAN_S, the emission signal EM and the first sensing signal SENSE_V are switched to the low voltage level, and the preset signal PRESET is switched to the high voltage level. The fourth transistor Tsd and the preset circuit 13 are turned off, the first transistor Te, the switch transistor Tss, the first sensing transistor Tsv and the fifth transistor Tsv2 are turned on. The output signal Vout is changed to be the same as the voltage Vf due to negative feedback. In addition, since the voltage Vf is transmitted through the data line DL, the voltage VDL of the data line is changed to be the same as the voltage Vf.

In a third time region T3, the second scan signal SCAN_S remains at the low voltage level, the emission signal EM and the first sensing signal SENSE_V are switched to the high voltage level, and the second sensing signal SENSE_I is switched to the low voltage level. The current If is guided to be flown through the resistor Rsi, and resulted in a voltage drop dV to be correspondingly occurred in the output signal Vout. Therefore, the current If can be calculated by dividing the voltage drop dV to a resistance of the resistor Rsi.

In short, since the data line DL is utilized for transmitting the data voltage Vd, the voltage Vf, and the current If. Since a transmission time for each signal on the data line DL is relatively compressed, the signals transmitted through the data line DL are more likely to be affected by parasitic resides on the data line DL, further deteriorating signal integrity of the pixel circuit 20 and the current monitor 21. In order to avoid signals to be affected by parasitic capacitance exhibited on the data line DL, the preset circuit 13 may be disposed to preset the voltage DL in between. Specifically, the preset circuit 13 may preset the voltage VDL in the preset time region TPS between the first time region T1 and the second time region T2, such that the voltage VDL of the data line DL may be changed from the data voltage Vd to the preset voltage Vpr before transmitting the voltage Vf. As a result, the voltage Vf can be correctly outputted to the current monitor 21 for detection.

Figure 5A:
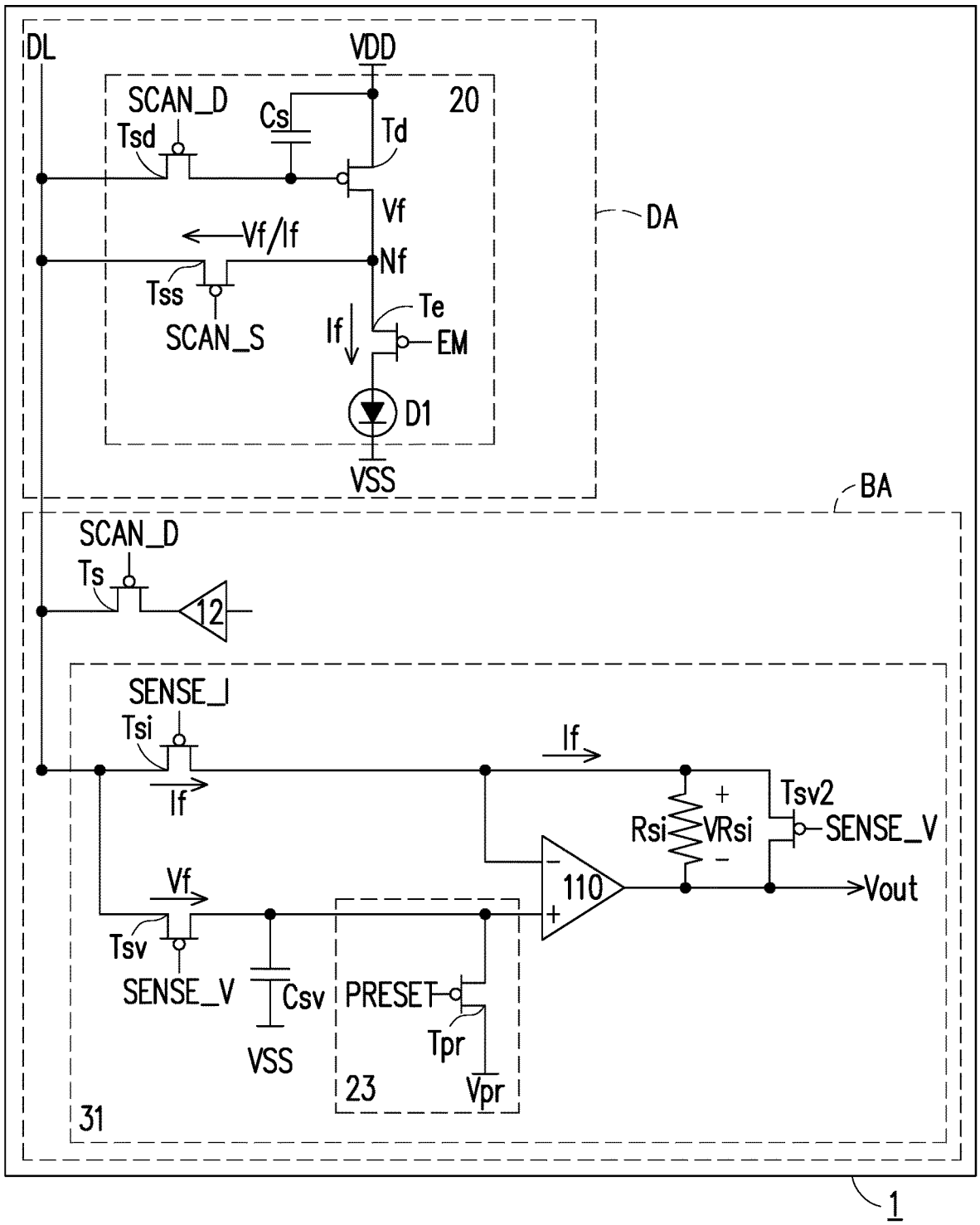
FIG. 5A is a schematic diagram of a display device according to an embodiment of the disclosure.

FIG. 5A is a schematic diagram of a display device 1 according to an embodiment of the disclosure. FIG. 5A is similar to FIG. 4A, except that in FIG. 5A, the preset circuit 23 is disposed inside the current monitor 31.

The current monitor 31 is coupled to the data line DL for detecting the current If of the node Nf between the driving transistor Td and the first transistor Te. The current monitor 31 includes a first sensing transistor Tsv, a second sensing transistor Tsi, an operational amplifier 110, a resistor Rsi, a capacitor Csv, and a preset circuit 23. The first sensing transistor Tsv has a first end coupled to the switch transistor Tss through the data line DL, a second end coupled to the operational amplifier 110, and a control end receiving a first sensing signal SENSE_V. The second sensing transistor Tsi has a first end coupled to the switch transistor Tss through the data line DL, a second end coupled to the operational amplifier 110, and a control end receiving a second sensing signal SENSE_I. The operational amplifier 110 has a first input end coupled to the second end of the first sensing transistor Tsv, a second input end coupled to the second end of the second sensing transistor Tsi, and an output end for generating an output signal Vout. The resistor Rsi is connected between the second input end of the operational amplifier 110 and the output end of the operational amplifier 110. The capacitor Csv is coupled between the first input end of the operational amplifier 110 and the second reference voltage VSS.

The preset circuit 23 is coupled to the first input end of the operational amplifier 110 for presetting the data line DL. Specifically, the preset circuit 23 is coupled between the first input end of the operational amplifier 110 and the preset voltage Vpr. The preset circuit 23 is controlled by a preset signal PRESET to determine whether to provide the preset voltage Vpr to the first input end of the operational amplifier 110. In one embodiment, the preset circuit 23 may be a PMOS transistor Tpr which has a first end coupled to the first input end of the operational amplifier 110, a second end receiving the preset voltage Vpr, and a control end receiving the preset signal PRESET.

Figure 5B:
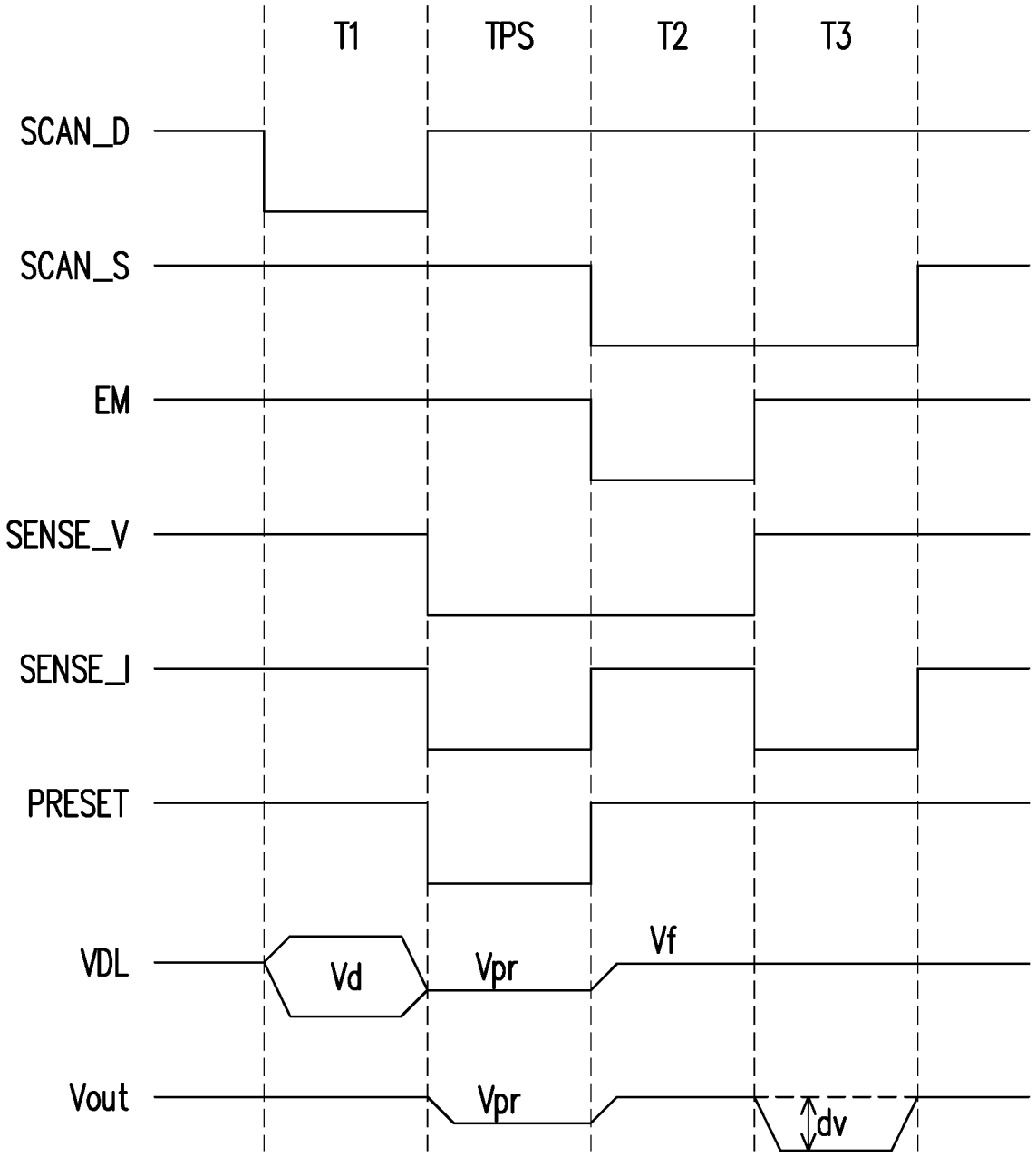
FIG. 5B is a schematic diagram showing operation waveforms of the display device illustrated in FIG. 5A according to an embodiment of the disclosure.

FIG. 5B is a schematic diagram showing operation waveforms of the display device 1 illustrated in FIG. 5A according to an embodiment of the disclosure. FIG. 5B is similar to FIG. 4B, except that the first sensing signal SENSE_V and the second sensing signal SENSE_I are changed to the low voltage level in the preset time region, and the second sensing signal SENSE_I is switched back to the high voltage level in the second time region T2.

In a first time region T1, the first scan signal SCAN_D is switched from a high voltage level to a low voltage level, and thus the fourth transistor Tsd and the fifth transistor Ts are turned on. The data voltage Vd is provided from the data driver 12 to the data line DL, so that a voltage VDL of the data line DL carries the data voltage Vd and is stored by the capacitor Cs during the first time region T1.

In a preset time region TPS, the first scan signal SCAN_D is switched to the high voltage level, the preset signal PRESET, the first sensing signal SENSE_V and the second sensing signal SENSE_I are switched to the low voltage level. The fourth switch Tsd is turned off. The preset transistor Tpr, the first sensing transistor Tsv1, the second sensing transistor Tsi, and the third sensing transistor Tsv2 are turned on. Therefore, the voltage VDL of the data line DL along with the output signal Vout are changed to be the same as the preset voltage Vpr.

In a second time region T2, the preset signal PRESET is switched to the high voltage level, the second scan signal SCAN_S and the emission signal are switched to the low voltage level and the first sensing signal SENSE_V remains at the low voltage. the first transistor EM, the switch transistor Tss, the first sensing transistor Tsv and the fifth transistor Tsv2 are turned on. The output signal Vout is changed to be the same as the voltage Vf due to negative feedback. In addition, since the voltage Vf is transmitted through the data line DL, the voltage VDL of the data line is changed to be the same as the voltage Vf.

In a third time region T3, the second scan signal SCAN_S remains at the low voltage level, the emission signal EM and the first sensing signal SENSE_V are switched to the high voltage level, and the second sensing signal SENSE_I is switched to the low voltage level. The current If is guided to be flown through the resistor Rsi, and resulted in a voltage drop dV to be correspondingly occurred in the output signal Vout. Therefore, the current If can be calculated by dividing the voltage drop dV to a resistance of the resistor Rsi.

Figure 6A:
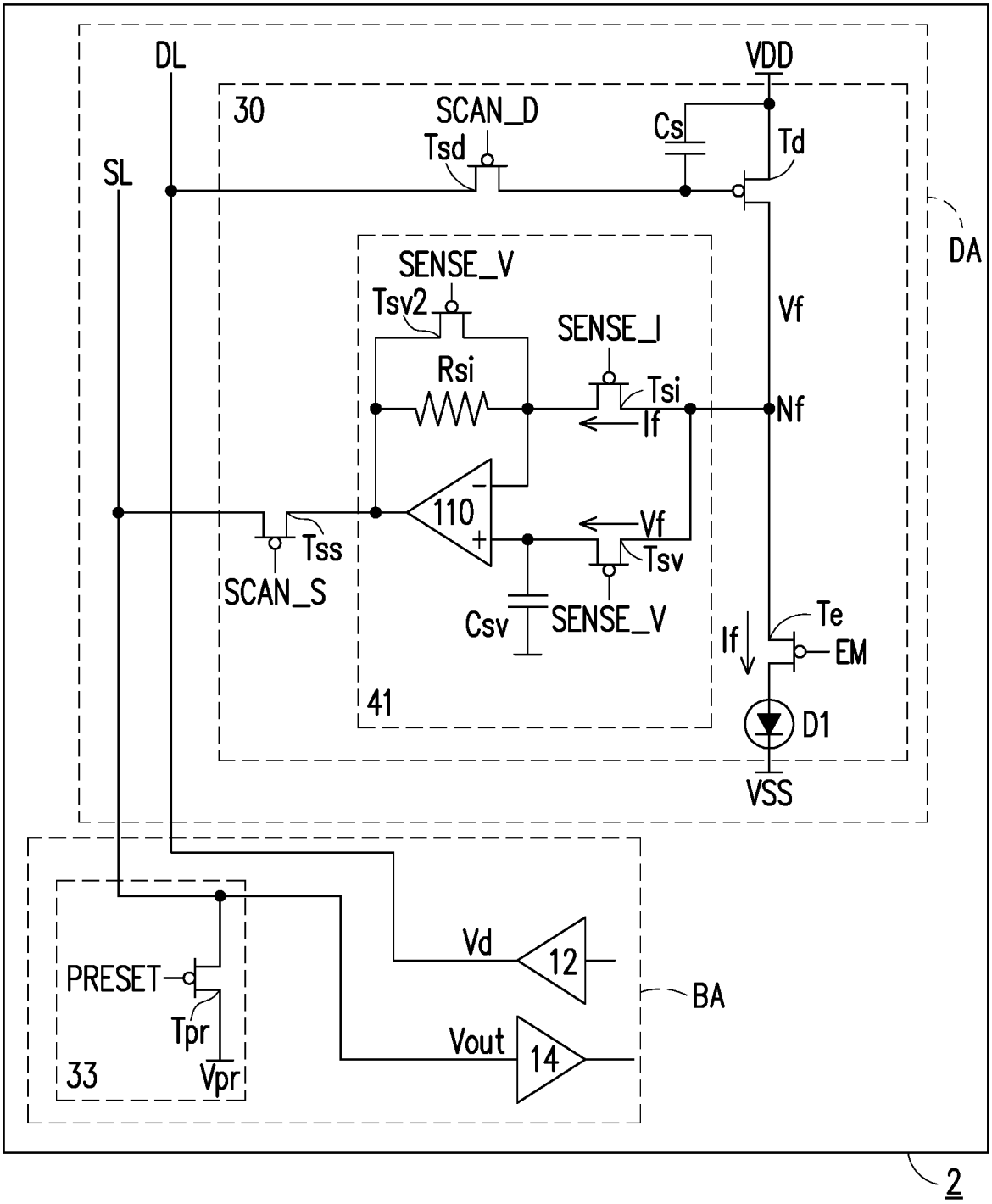
FIG. 6A is a schematic diagram of a display device according to an embodiment of the disclosure.

FIG. 6A is a schematic diagram of a display device 2 according to an embodiment of the disclosure. The display device 2 includes a plurality of pixel circuits 30, while only one pixel circuit 30 is illustrated in FIG. 6A for ease of understanding. The pixel circuit 30 is similar to the pixel circuit 10 illustrated in FIG. 1A except that a current monitor 41 is embedded in the pixel circuit 30, and is particularly connected between the node Nf and the switch transistor Tss. In such embodiment, each pixel circuit 30 includes one current monitor 41.

Specifically, the pixel circuit 30 includes a switch transistor Tss, a driving transistor Td, a first transistor Te, a light emitting unit D1 and a current monitor 41. The driving transistor Td is coupled to the switch transistor Tss. The first transistor Te is coupled to the switch transistor Tss. The light emitting unit D1 is coupled to the first transistor Te. The current monitor 41 is connected between the node Nf and the switch transistor Tss.

The driving transistor Td has a first end receiving a first reference voltage VDD, a second end coupled to the node Nf, a control end coupled to a fourth transistor Tsd. The first transistor Te has a first end coupled to the node Nf, a second end coupled to the light emitting unit D1, and a control end receiving an emission signal EM. The light emitting unit D1 has a first end coupled to the second of the first transistor Te and a second end receiving a second reference voltage VSS. The fourth transistor Tsd has a first end coupled to a data line DL, a second end coupled to the control end of the driving transistor Td, and a control end receiving a first scan signal SCAN_D. The switch transistor Tss has a first end coupled to a sense line SL, a second end coupled to the current monitor 41 and a control end receiving a second scan signal SCAN_S. The capacitor Cs has a first receiving the first reference voltage VDD and a second coupled to the control end of the driving transistor Td. A data driver 12 is coupled to the data line DL for providing a data voltage Vd. A data converter 14 is coupled to the sense line SL for receiving an output signal Vout generated by the current monitor 41.

Specifically, the current monitor 41 is connected between the second end of the switch transistor Tss and the node Nf. The current monitor 41 includes a first sensing transistor Tsv, a second sensing transistor Tsi, an operational amplifier 110, a resistor Rsi, and a capacitor Csv.

The first sensing transistor Tsv has a first end coupled to the operational amplifier 110, a second end coupled to the node Nf, and a control end receiving a first sensing signal SENSE_V. The second sensing transistor Tsi has a first end coupled to the operational amplifier 110, a second end coupled to the node Nf, and a control end receiving a second sensing signal SENSE_I. The operational amplifier 110 has a first input end coupled to the first end of the first sensing transistor Tsv, a second input end coupled to the first input end of the second sensing transistor Tsi, and an output end generating an output signal Vout and coupled to the second end of the switch transistor Tss. The resistor Rsi is connected between the second input end of the operational amplifier 110 and the output end of the operational amplifier 110. The capacitor Csv is coupled between the first input end of the operational amplifier 110 and the second reference voltage VSS.

Optionally, a preset circuit 33 connected to the sense line SL may be disposed. The preset circuit 33 is coupled between the sense line SL and a preset voltage Vpr. The preset circuit 33 is controlled by a preset signal PRESET to determine whether to provide the preset voltage Vpr to the sense line SL. In one embodiment, the preset circuit 33 may be a PMOS transistor Tpr which has a first end coupled to the sense line SL, a second end receiving the preset voltage Vpr, and a control end receiving the preset signal PRESET.

Figure 6B:
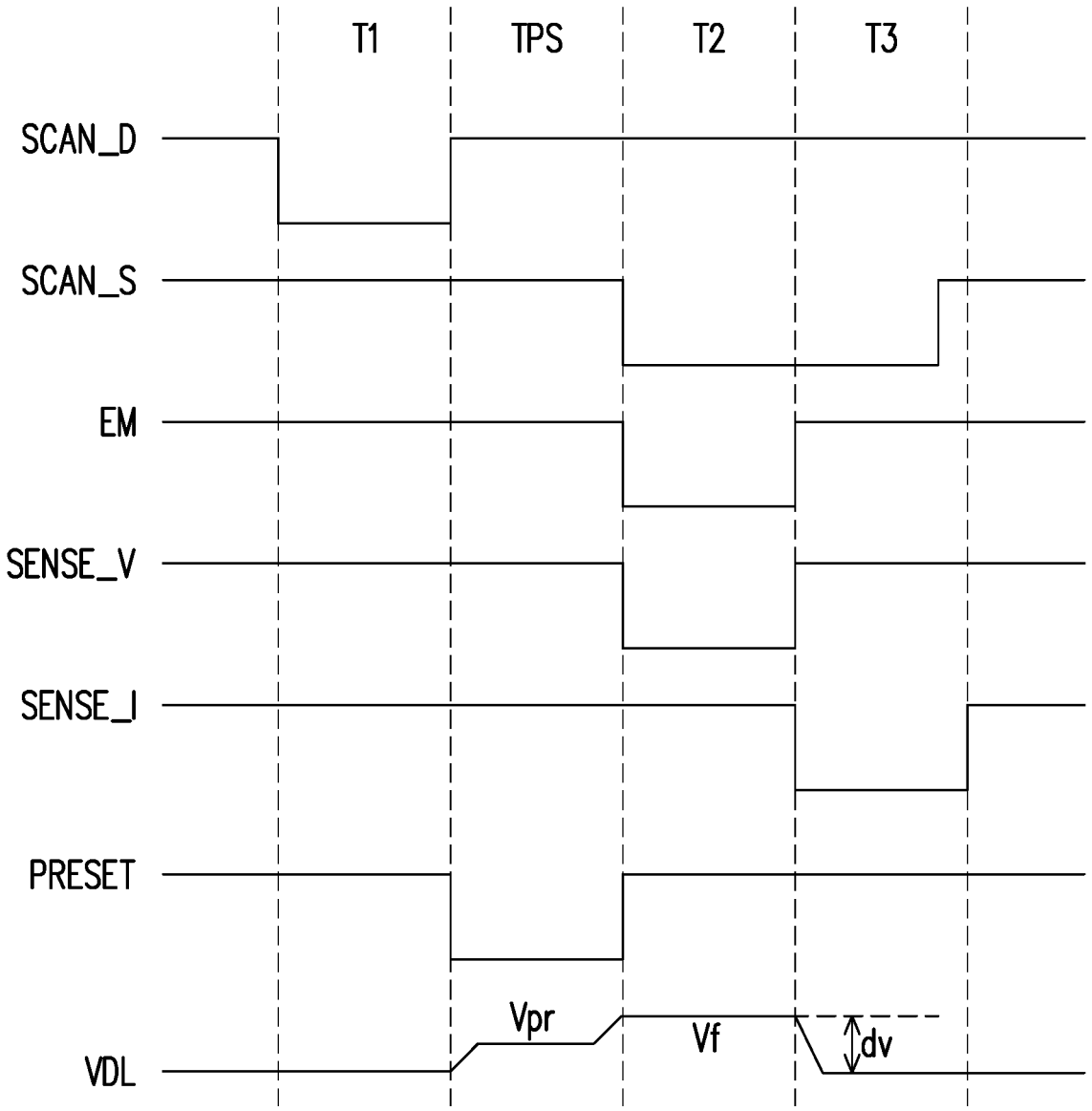
FIG. 6B is a schematic diagram showing operation waveforms of the display device illustrated in FIG. 6A according to an embodiment of the disclosure.

FIG. 6B is a schematic diagram showing operation waveforms of the display device 2 illustrated in FIG. 6A according to an embodiment of the disclosure.

In a first time region T1, the first scan signal SCAN_D is switched to the low voltage level, so the fourth transistor Tsd is turned on and the data voltage Vd is provided to the control end of the driving transistor Td through the data line DL.

In a preset time region TPS, the preset signal PRESET is switched to the low voltage level, so the preset circuit 33 is turned on and the voltage VSL of the sense line SL is changed to be the same as the preset voltage Vpr, optionally In a second time region T2, the emission signal EM and the first sensing signal SENSE_V are switched to the low voltage level. The first transistor Te and the switch transistor Tss are turned on and the voltage Vf of the node Nf is outputted to the first input end of the operational amplifier 110 through the first sensing transistor Tsv. The voltage VSL of the sense line SL is changed to be the same as the voltage Vf through negative feedback, so the voltage Vf can be outputted to the data converter 14 in the second time region T2.

In a third time region T3, the second sensing signal SENSE_I is switched to the low voltage level and the emission signal EM and the first sensing signal SENSE_V are switched to the high voltage level, so the second sensing transistor Tsi is turned on and the first transistor Te and the first sensing transistor Tsv and the third sensing transistor Tsv2 are turned off. The current If is redirected and detected by the current monitor 41. Moreover, the current If flows through the resistor Rsi, and thus a corresponding voltage drop dV occurred on the voltage VSL of the sense line SL. Therefore, the current If may be obtained by dividing the voltage drop dV to a resistance of the resistor Rsi, and the output signal Vout containing information about the current If can be outputted to the data converter 14 in the third time region T3. In this embodiment, the current monitor 41 is embedded in the pixel circuit 30, the current If can flow to the current monitor 41 without passing the signal line SL.

Figure 7A:
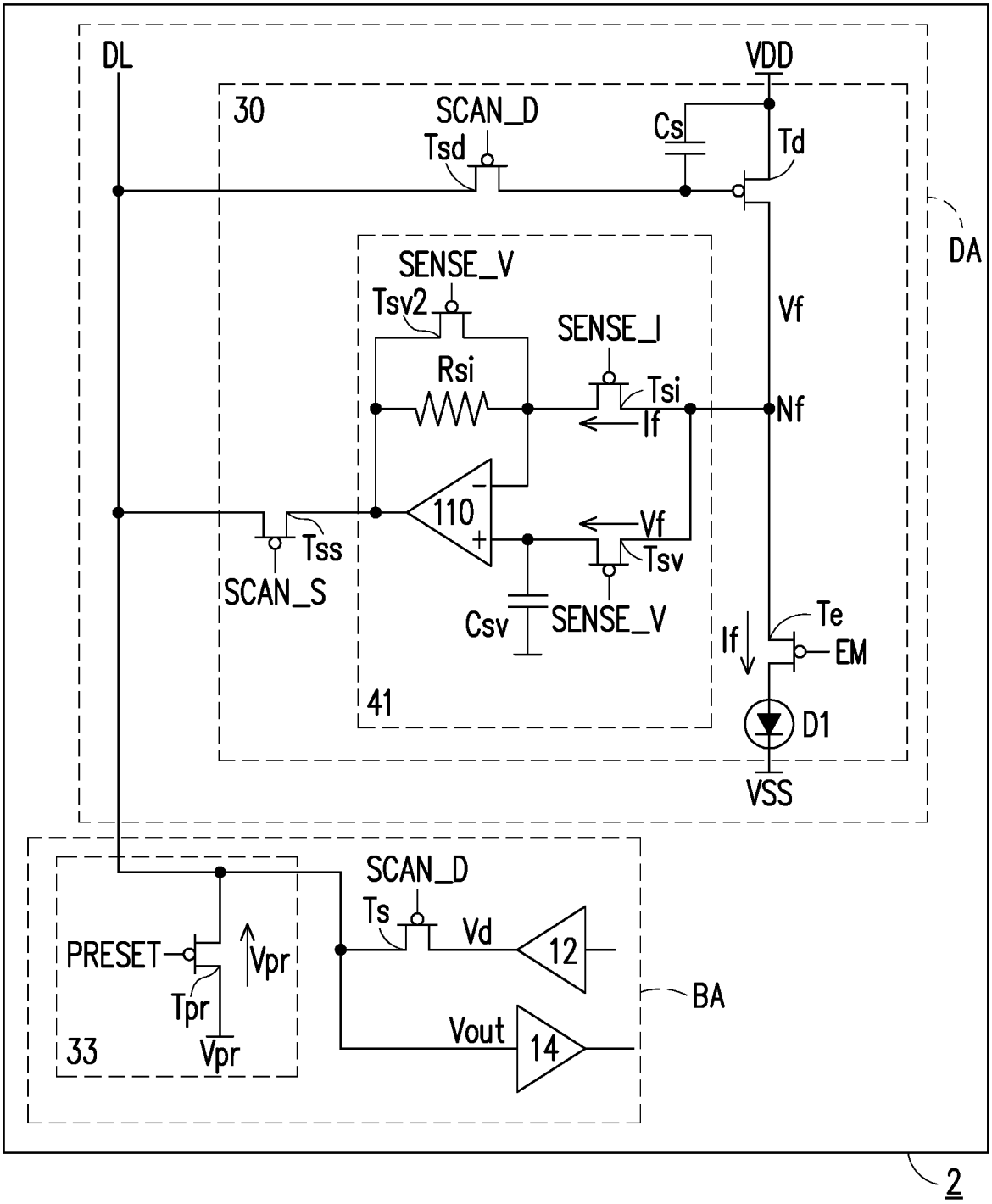
FIG. 7A is a schematic diagram of a display device according to an embodiment of the disclosure.

FIG. 7A is a schematic diagram of a display device 2 according to an embodiment of the disclosure. FIG. 7A is similar to FIG. 6A that a current monitor 41 is embedded in the pixel circuit 30 as illustrated in FIG. 7A, except that the voltage Vf and the current If of the node Nf is outputted to the data converter through the data line DL instead of the sense line SL. In other words, the data line DL is utilized for transmitting the data voltage Vd, the voltage Vf, and the current If.

The pixel circuit 30 includes a switch transistor Tss, a driving transistor Td, a first transistor Te, a light emitting unit D1 and a current monitor 41. The driving transistor Td is coupled to the switch transistor Tss. The first transistor Te is coupled to the switch transistor Tss. The light emitting unit D1 is coupled to the first transistor Te. The current monitor 41 is connected between the node Nf and the switch transistor Tss.

The driving transistor Td has a first end receiving a first reference voltage VDD, a second end coupled to the node Nf, a control end coupled to a fourth transistor Tsd. The first transistor Te has a first end coupled to the node Nf, a second end coupled to the light emitting unit D1, and a control end receiving an emission signal EM. The light emitting unit D1 has a first end coupled to the second of the first transistor Te and a second end receiving a second reference voltage VSS. The fourth transistor Tsd has a first end coupled to a data line DL, a second end coupled to the control end of the driving transistor Td, and a control end receiving a first scan signal SCAN_D. The switch transistor Tss has a first end coupled to a data line DL, a second end coupled to the current monitor 41 and a control end receiving a second scan signal SCAN_S. A capacitor Cs has a first receiving the first reference voltage VDD and a second coupled to the control end of the driving transistor Td. A data driver 12 is coupled to the data line DL for providing a data voltage Vd. A data converter 14 is coupled to the data line DL for receiving an output signal Vout generated by the current monitor 41.

The current monitor 41 is connected between the second end of the switch transistor Tss and the node Nf. The current monitor 41 includes a first sensing transistor Tsv, a second sensing transistor Tsi, an operational amplifier 110, a resistor Rsi, and a capacitor Csv.

The first sensing transistor Tsv has a first end coupled to the operational amplifier 110, a second end coupled to the node Nf, and a control end receiving a first sensing signal SENSE_V. The second sensing transistor Tsi has a first end coupled to the operational amplifier 110, a second end coupled to the node Nf, and a control end receiving a second sensing signal SENSE_I. The operational amplifier 110 has a first input end coupled to the first end of the first sensing transistor Tsv, a second input end coupled to the first input end of the second sensing transistor Tsi, and an output end generating an output signal Vout. The resistor Rsi is connected between the second input end of the operational amplifier 110 and the output end of the operational amplifier 110. The capacitor Csv is coupled between the first input end of the operational amplifier 110 and the second reference voltage VSS.

Specifically, a fifth transistor Ts connected between the data line DL and the data driver 12 is disposed. The fifth transistor Ts may be a P-type MOS transistor, which has a first end connected to the data line DL, a second end coupled to an output end of the data driver 12 and a control end receiving a first scan signal SCAN_D. Therefore, the fifth transistor Ts may isolate the data driver 12, so the data line DL can be utilized for transmitting the data voltage Vd, the voltage Vf, and the current If, without interference.

In addition, a preset circuit 33 is disposed to be connected to the data line DL. The preset circuit 33 is coupled between the data line DL and a preset voltage Vpr. The preset circuit 33 is controlled by a preset signal PRESET to determine whether to provide the preset voltage Vpr to the data line DL. In one embodiment, the preset circuit 33 may be a PMOS transistor Tpr which has a first end coupled to the data line DL, a second end receiving the preset voltage Vpr, and a control end receiving the preset signal PRESET.

Figure 7B:
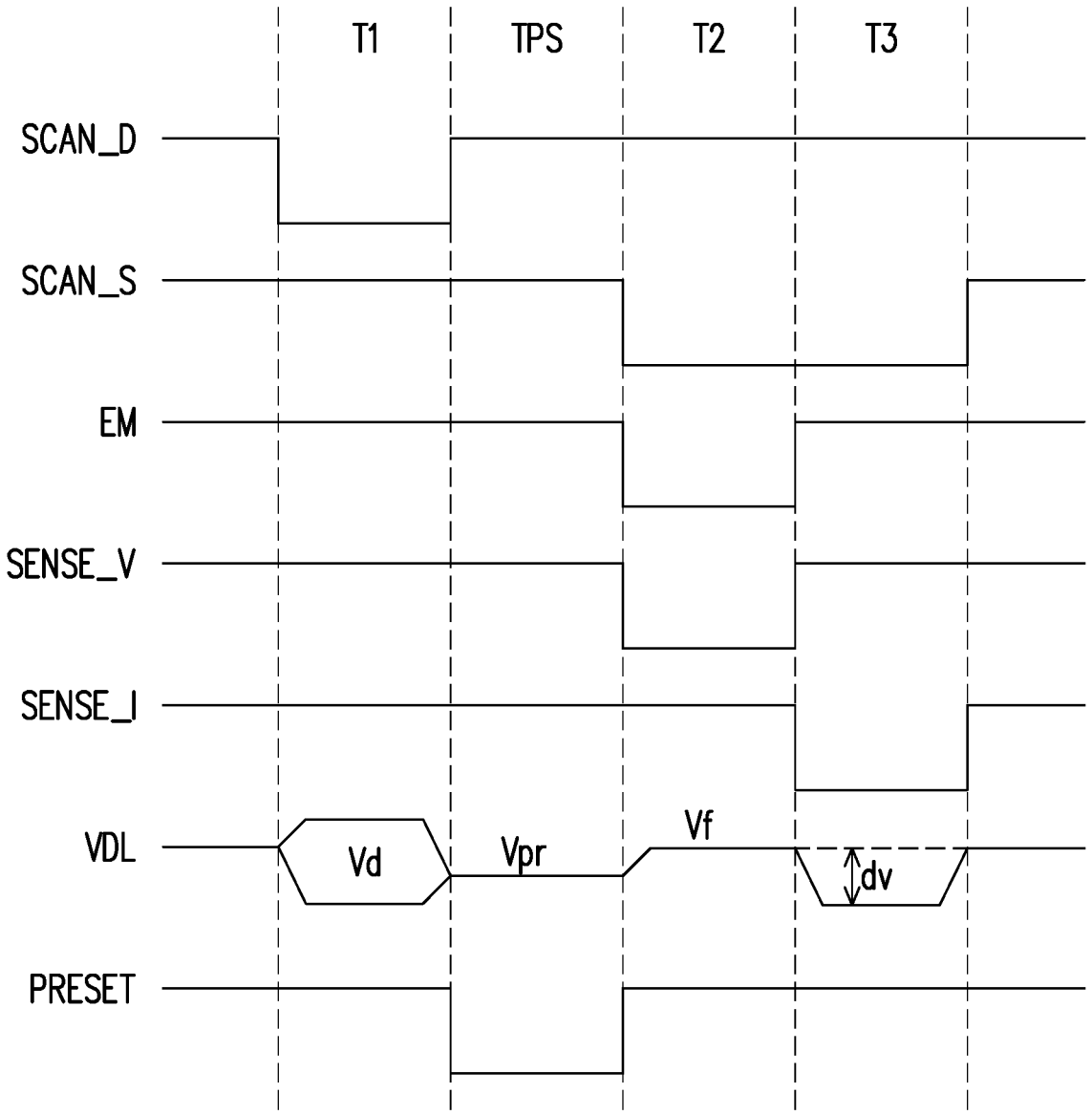
FIG. 7B is a schematic diagram showing operation waveforms of the display device illustrated in FIG. 7A according to an embodiment of the disclosure.

FIG. 7B is a schematic diagram showing operation waveforms of the display device 2 illustrated in FIG. 7A according to an embodiment of the disclosure.

In a first time region T1, the first scan signal SCAN_D is switched to the low voltage level, so the fourth transistor Tsd and the fifth transistor Ts are turned on and the data voltage Vd is provided from the data driver 12 to the control end of the driving transistor Td through the data line DL.

In a preset time region TPS, the preset signal PRESET is switched to the low voltage level, so the preset circuit 33 is turned on and the voltage VDL of the data line DL is changed to be the same as the preset voltage Vpr.

In a second time region T2, the second scan signal SCAN_S, the emission signal EM and the first sensing signal SENSE_V are switched to the low voltage level. The switch transistor Tss and the first transistor Te are turned on, so the voltage Vf of the node Nf is outputted to the first input end of the operational amplifier 110 through the first sensing transistor Tsv. The voltage VDL of the data line DL is changed to be the same as the voltage Vf through negative feedback, so the voltage Vf can be outputted to the data converter 14 in the second time region T2.

In a third time region T3, the second sensing signal SENSE_I is switched to the low voltage level and the emission signal EM is switched to the high voltage level, so the first transistor Te is turned off and the second sensing transistor Tsi is turned on. The current If of the node Nf is detected by the current monitor 41. Accordingly, a corresponding voltage drop dV occurred on the voltage VDL of the data line DL. Therefore, the current If may be obtained by dividing the voltage drop dV to a resistance of the resistor Rsi, and the output signal Vout containing information about the current If can be outputted to the data converter 14 in the third time region T3.

Figure 8A:
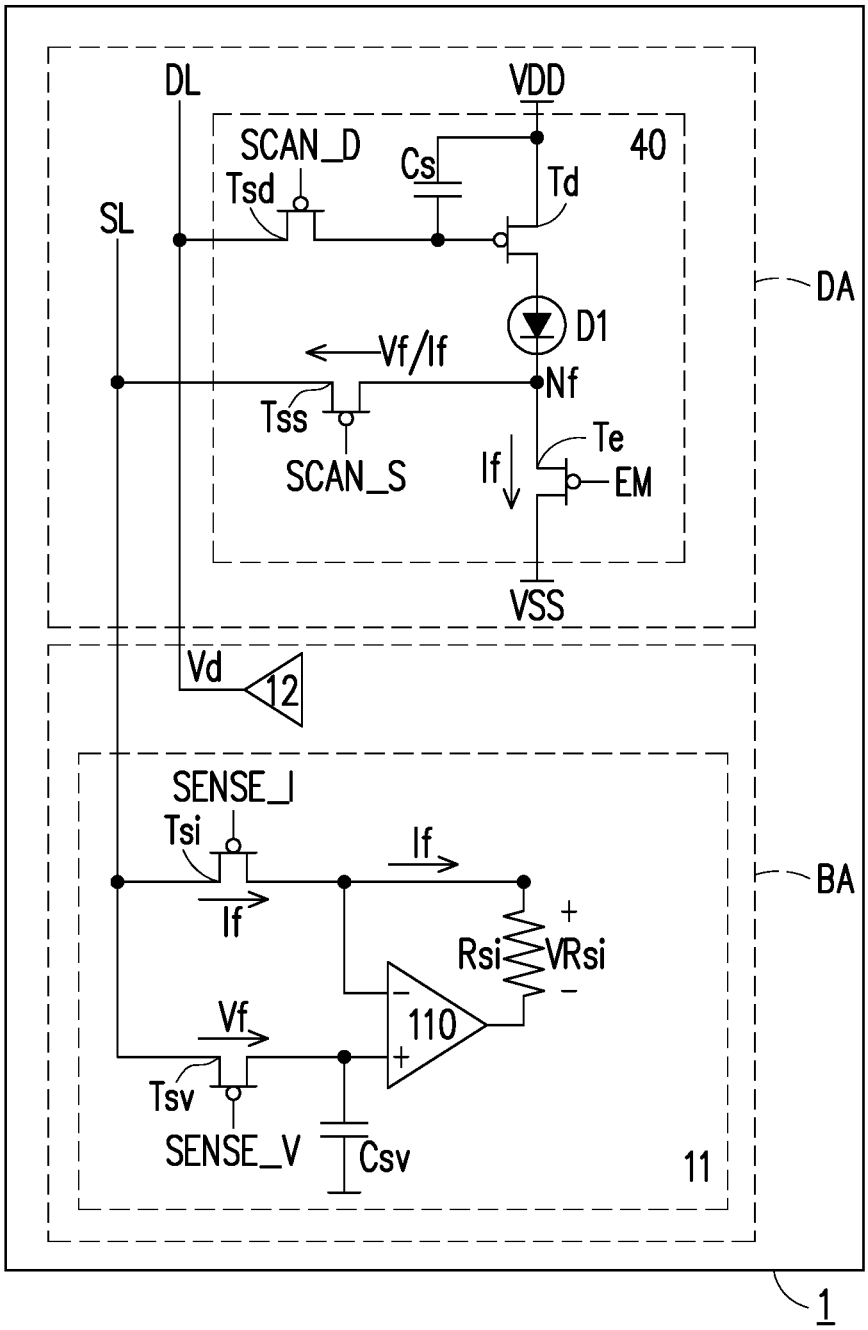
FIG. 8A is a schematic diagram of a display device according to an embodiment of the disclosure.

FIG. 8A is a schematic diagram of a display device 1 according to an embodiment of the disclosure. FIG. 8A is similar to FIG. 1A, except that the pixel circuit 10 in FIG. 1A is replaced by a pixel circuit 40 in FIG. 8A.

Specifically, the pixel circuit 40 is similar to the pixel circuit 10 illustrated in FIG. 1A, except that the first transistor Te, the driving transistor Td, and the light emitting unit D1 is serially connected in a different order. The pixel circuit 40 is coupled to a current monitor 11, which detects the current If extracted from the node Nf. In some embodiments, the current monitor 11 also detects the voltage Vf extracted from the node Nf.

The pixel circuit 40 includes a switch transistor Tss, a driving transistor Td, a first transistor Te, a fourth transistor Tsd, a light emitting unit D1, and a capacitor Cs. The driving transistor Td has a first end receiving a first reference voltage VDD, a second end coupled to the node Nf through the light emitting unit D1 and a control end coupled to the fourth transistor Tsd. The light emitting unit D1 has a first end coupled to the second end of the driving transistor Td and a second end coupled to the node Nf. The first transistor Te has a first end coupled to the node Nf, a second end receiving a second reference voltage VSS, and a control end receiving an emission signal EM. The switch transistor Tss has a first end coupled to a sense line, a second end coupled to the node Nf, and a control end receiving a second scan signal SCAN_S. The fourth transistor Tsd has a first end coupled to a data line DL, a second end coupled to the control end of the driving transistor Td, and a control end receiving a first scan signal SCAN_D. The capacitor Cs has a first end coupled to the control end of the driving transistor Td and a second end receiving the first reference voltage VDD.

Figure 8B:
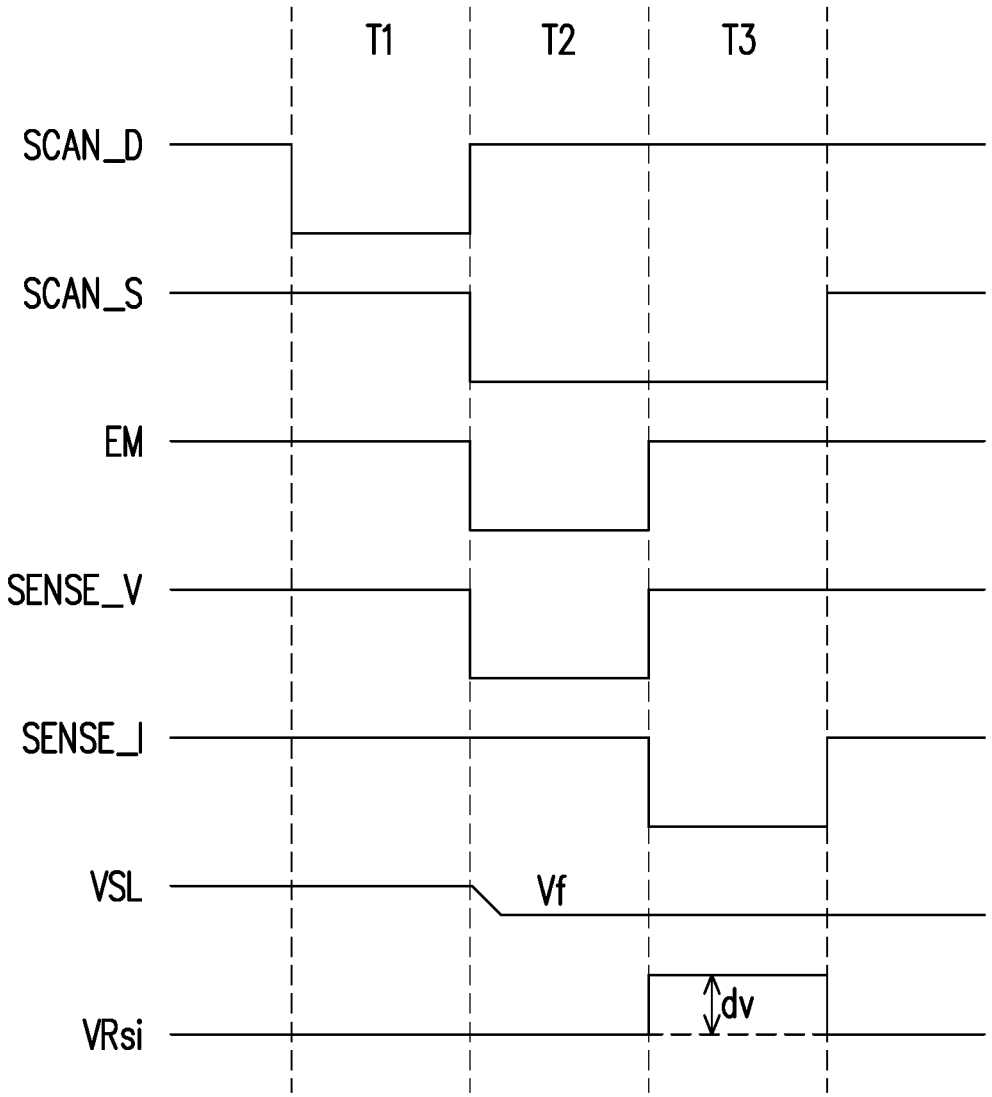
FIG. 8B is a schematic diagram showing operation waveforms of the display device illustrated in FIG. 8A according to an embodiment of the disclosure.

FIG. 8B is a schematic diagram showing operation waveforms of the display device 1 illustrated in FIG. 8A according to an embodiment of the disclosure. FIG. 8B is similar to FIG. 1B, so please refer to paragraphs related FIG. 1B for detailed operations of the pixel circuit 40 and the current monitor 11 in the first time region T1, the second time region T2 and the third time region T3.

Moreover, persons having ordinary skill in the art may alter the structure of pixel circuit 40 as illustrated in FIG. 8A in order to improve adaptability of the pixel circuit 40. For example, connections of the switch transistor Tss and the current monitor 11 can be modified to be connected to the data line DL, so the data line DL may be utilized by both of the pixel circuit 40 and the current monitor 11 to transmit the data voltage Vd, the voltage Vf and the current If.

Figure 9A:
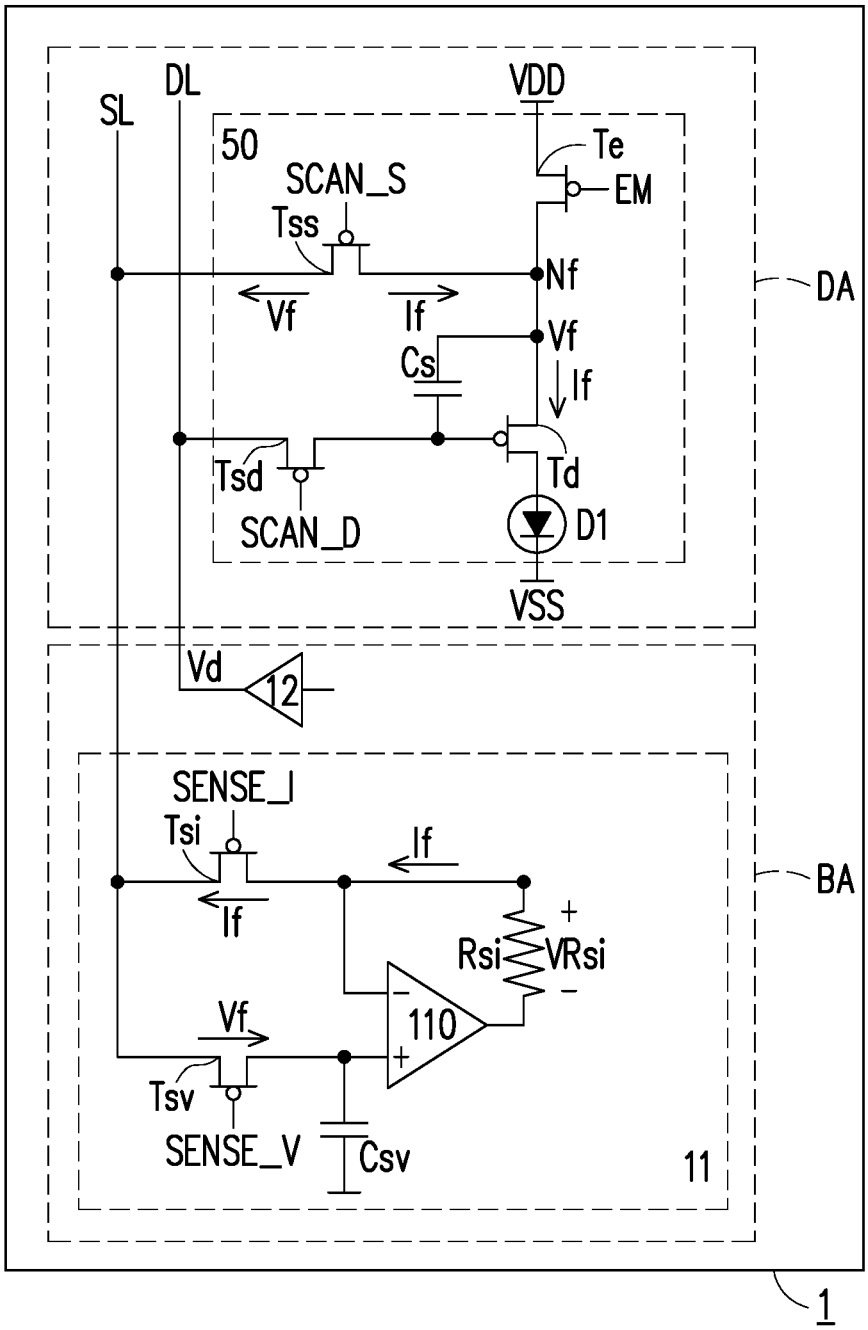
FIG. 9A is a schematic diagram of a display device according to an embodiment of the disclosure.

FIG. 9A is a schematic diagram of a display device 1 according to an embodiment of the disclosure. FIG. 9A is similar to FIG. 1A, except that the pixel circuit 10 in FIG. 1A is replaced by a pixel circuit 50 in FIG. 9A.

Specifically, the pixel circuit 50 is similar to the pixel circuit 10 illustrated in FIG. 1A, except that the first transistor Te, the driving transistor Td, and the light emitting unit D1 is serially connected in a different order. The pixel circuit 50 is coupled to a current monitor 11, which detects the current If of the node Nf. In some embodiments, the current monitor 11 also detects the voltage Vf of the node Nf.

The pixel circuit 50 includes a switch transistor Tss, a driving transistor Td, a first transistor Te, a fourth transistor Tsd, a light emitting unit D1, and a capacitor Cs. The first transistor Te has a first end receiving a first reference voltage VDD, a second end coupled to the node Nf, and a control end receiving an emission signal EM. The driving transistor Td has a first end coupled to the node Nf, a second end coupled to the light emitting unit D1 and a control end coupled to the fourth transistor Tsd. The light emitting unit D1 has a first end coupled to the second end of the driving transistor Td and a second end receiving a second reference voltage VSS. The switch transistor Tss has a first end coupled to a sense line SL, a second end coupled to the node Nf, and a control end receiving a second scan signal SCAN_S. The fourth transistor Tsd has a first end coupled to a data line DL, a second end coupled to the control end of the driving transistor Td, and a control end receiving a first scan signal SCAN_D. The capacitor Cs has a first end coupled to the control end of the driving transistor Td and a second end receiving the first reference voltage VDD.

Figure 9B:
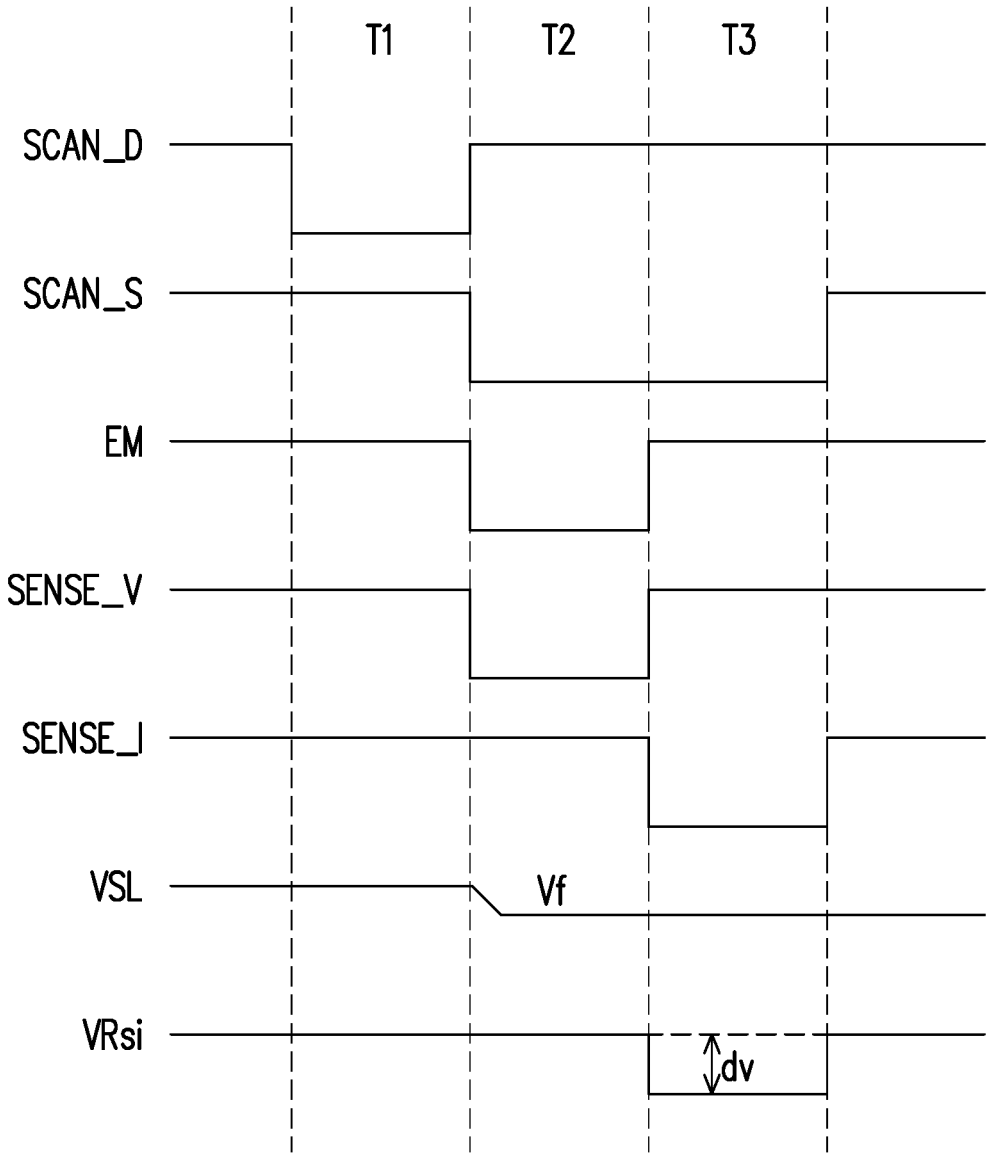
FIG. 9B is a schematic diagram showing operation waveforms of the display device illustrated in FIG. 9A according to an embodiment of the disclosure.

FIG. 9B is a schematic diagram showing operation waveforms of the display device 1 illustrated in FIG. 9A according to an embodiment of the disclosure. FIG. 9B is similar to FIG. 1B, so please refer to paragraphs related FIG. 1B for detailed operations of the pixel circuit 50 and the current monitor 11 in the first time region T1, the second time region T2 and the third time region T3.

Moreover, persons having ordinary skill in the art may alter the structure of pixel circuit 50 as illustrated in FIG. 9A in order to improve adaptability of the pixel circuit 50. For example, connections of the switch transistor Tss and the current monitor 11 can be modified to be connected to the data line DL, so the data line DL may be utilized by both of the pixel circuit 50 and the current monitor 11 to transmit the data voltage Vd, the voltage Vf, and the current If.

Figure 10A:
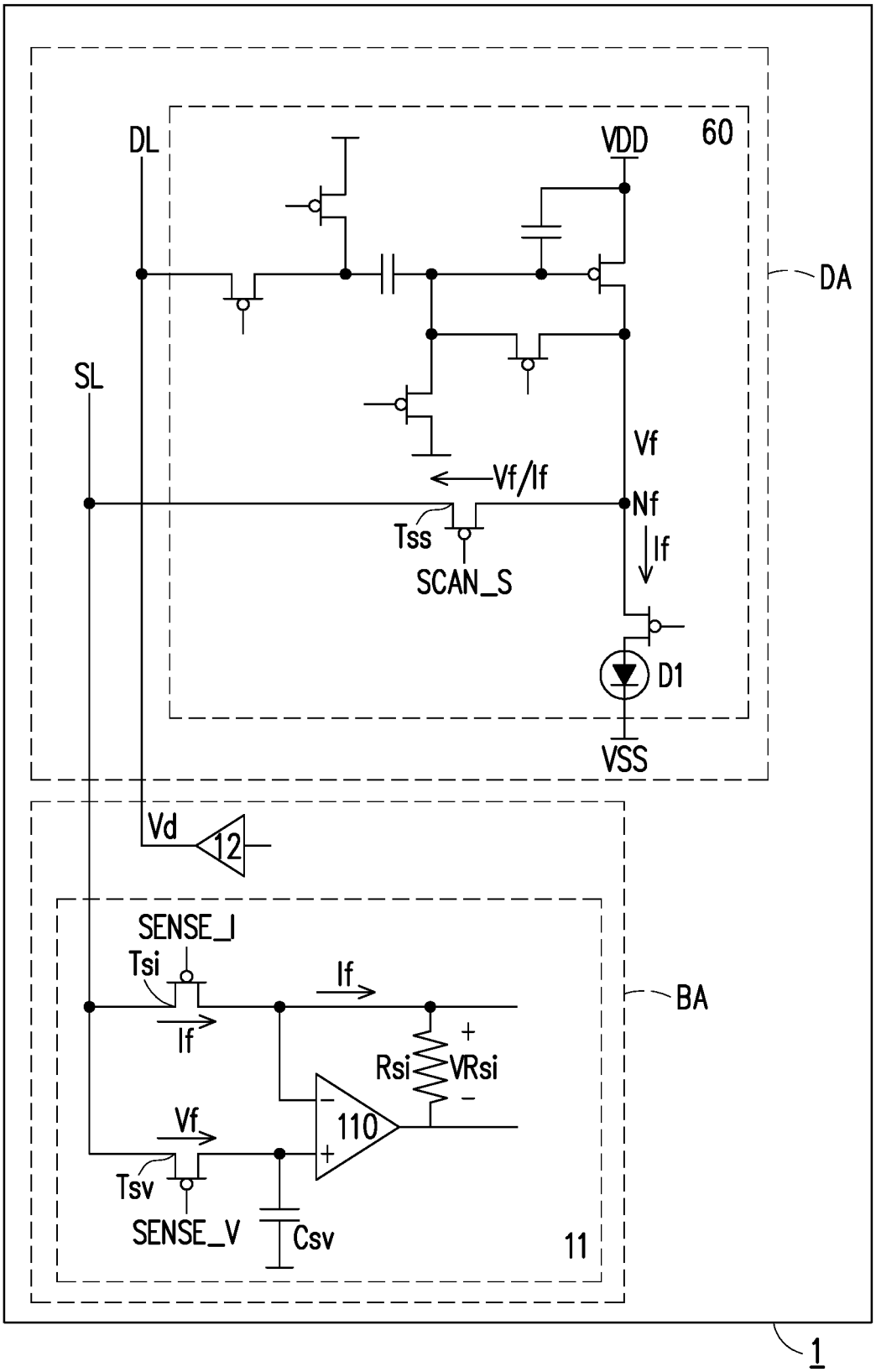
FIG. 10A is a schematic diagram of a display device according to an embodiment of the disclosure.

FIG. 10A is a schematic diagram of a display device 1 according to an embodiment of the disclosure. The pixel circuits 10-50 in the above paragraphs comprising relatively simple structures are just for exemplary purposes, and persons having ordinary skill in the art may alter, modify or replace those pixel circuits 10-50 by more complicated structure according to different design concepts. For example, any one of those pixel circuits 10-50 may be replaced by the pixel circuit 60. The pixel circuit 60 includes a circuit structure with six transistors one capacitor (6T1C) and a switch transistor Tss, which is capable of compensating threshold voltage of the pixel circuit 60. The switch transistor Tss outputs a current If and/or a voltage Vf of the node Nf to the sense line SL. The current If and/or the voltage Vf of the node is detected by a current monitor 11. Therefore, the pixel circuit 60 detects the current If and/or the voltage Vf information of the node Nf for detection.

Figure 10B:
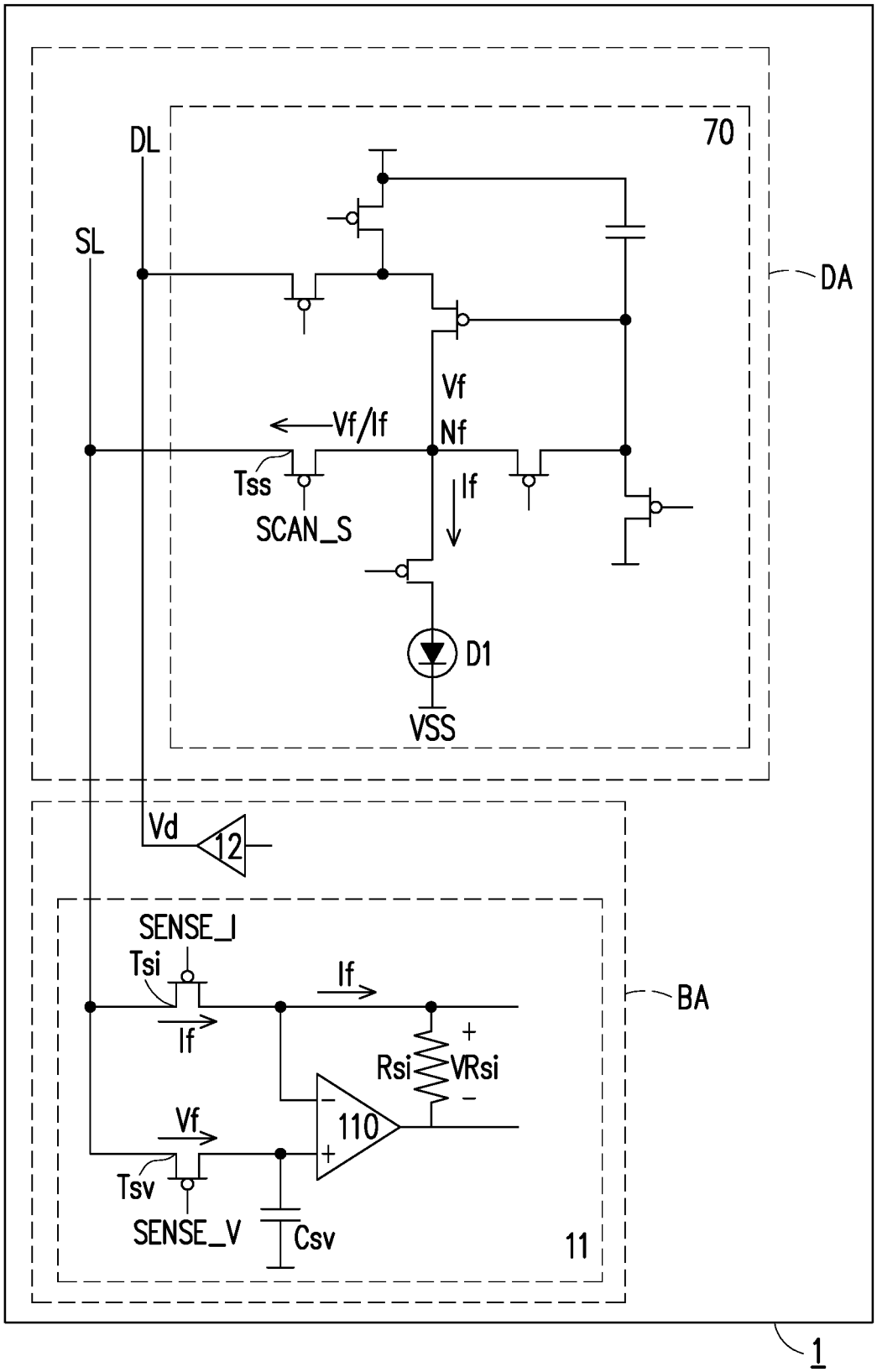
FIG. 10B is a schematic diagram of a display device according to an embodiment of the disclosure.

FIG. 10B is a schematic diagram of a display device 1 according to an embodiment of the disclosure. The pixel circuits 10-50 in the above paragraphs comprising relatively simple structures are just for exemplary purposes, and persons having ordinary skill in the art may alter, modify or replace those pixel circuits 10-50 by more complicated structure according to different design concepts. For example, any one of those pixel circuits 10-50 may be replaced by the pixel circuit 70. The pixel circuit 70 includes a circuit structure with six transistors two capacitor (6T2C) and a switch transistor Tss, which is capable of compensating threshold voltage of the pixel circuit 70. The switch transistor Tss outputs a current If and/or a voltage Vf of the node Nf. The current If and/or the voltage Vf of the node is detected by a current monitor 11. Therefore, the pixel circuit 70 detects the current If and/or the voltage Vf information of the node Nf for detection.

Figure 11A:
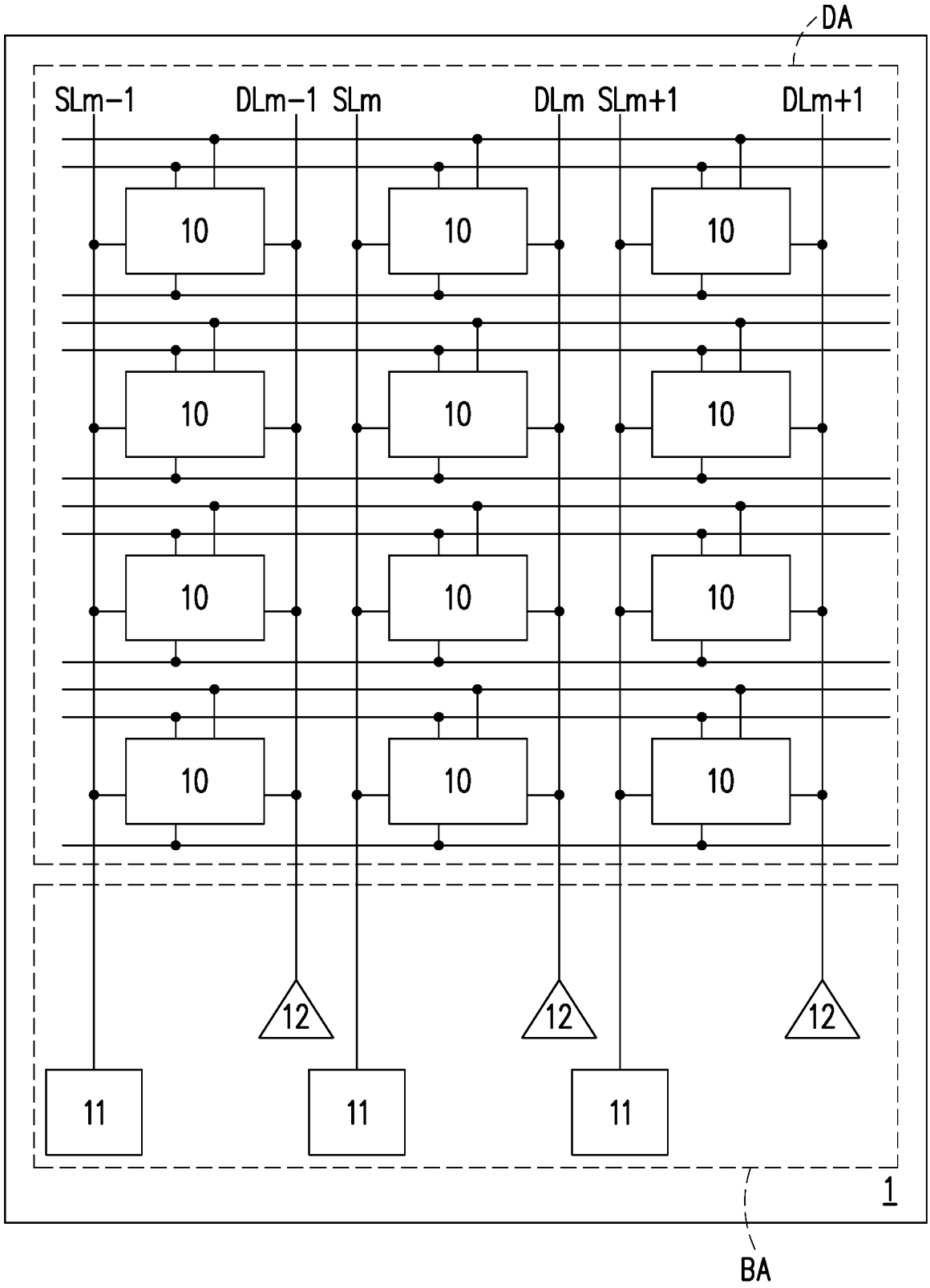
FIG. 11A is a partial view of a display device with pixel circuits and current monitors disposed inside according to an embodiment of the disclosure.

FIG. 11A is a partial view of a display device 1 with pixel circuits 10 and current monitors 11 disposed inside according to an embodiment of the disclosure. Specifically, the display device 1 includes pixel circuits 10, current monitors 11 and data drivers 12. The pixel circuits 10 are disposed in a display area DA and forming as a pixel array. The current monitors 11 and the data drivers 12 are disposed in a border area BA. The pixel circuits disposed in the same column are connected to a data line and a sense line. Each data line is coupled to a data driver 12 for providing a data voltage to the pixel circuits in the same column. Each sense line is coupled to a current monitor 11 for detecting a voltage and/or a current of a node connected between a driving transistor controlled by the data voltage and a first transistor controlled by an emission signal. Although not illustrated in FIG. 11A, the pixel circuits 10 disposed in the display device 1 may be replaced by the pixel circuits 20-70, and the current monitor 11 may also be replaced by the current monitors 11-31. Therefore, the current and/or the voltage information can be detected, and a relationship recording a V-I curve of the data voltage Vd to the current If of the pixel circuit 10 can be accordingly obtained without applying additional measuring equipment or probing circuit.

Figure 11B:
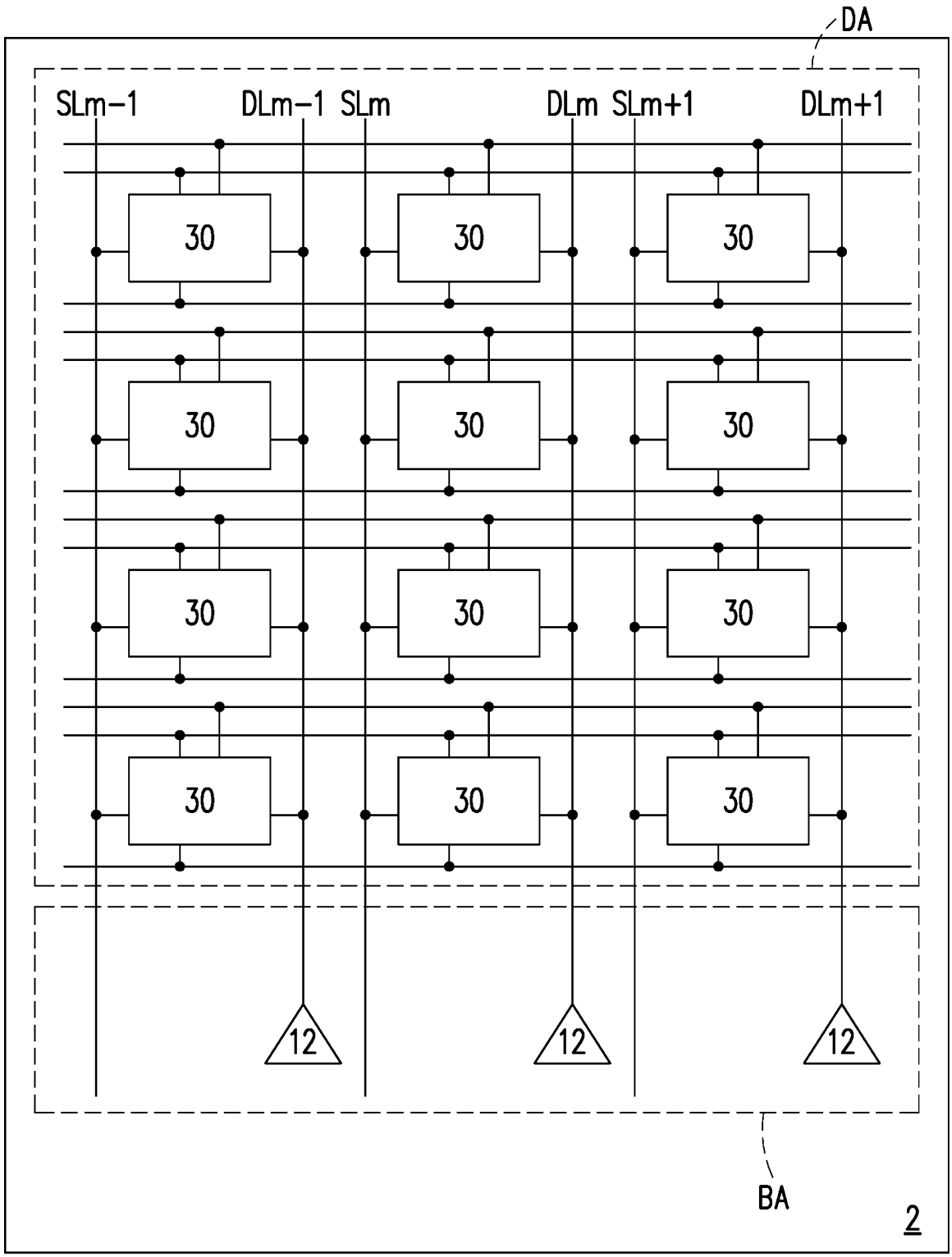
FIG. 11B is a partial view of a display device with pixel circuits disposed inside according to an embodiment of the disclosure.
Figure 11C:
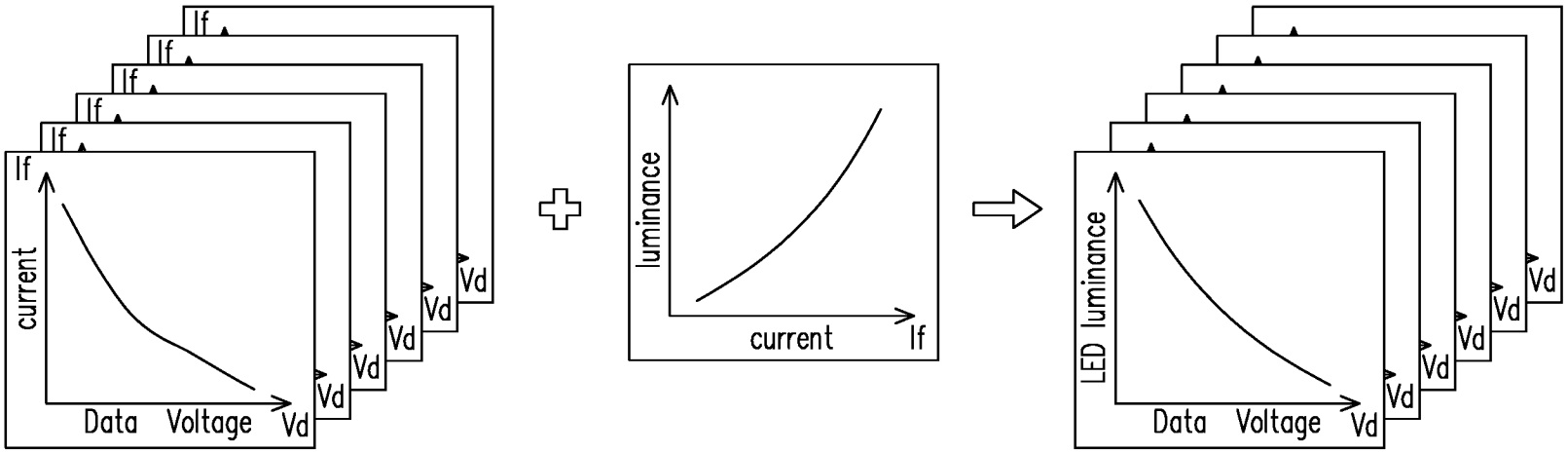
FIG. 11C is a schematic diagram of a calibration operation to the display device as illustrated in FIG. 11A or FIG. 11B according to an embodiment of the disclosure.

FIG. 11B is a partial view of a display device 2 with pixel circuits 30 disposed inside according to an embodiment of the disclosure. Specifically, the display device 2 includes pixel circuits 30 and data drivers 12. The pixel circuits 30 are disposed in a display area DA and forming as a pixel array. The data drivers 12 are disposed in a border area BA. In FIG. 11B, the current monitor is embedded in each pixel circuits 30 to detect the current and/or voltage therein. According to some embodiments, referring to FIG. 6A and FIG. 7A, the current monitor 41 can be disposed the pixel circuit 30. As such, a relationship recording a V-I curve of the data voltage Vd to the current If of the pixel circuit 30 can be accordingly obtained without applying additional measuring equipment or probing circuit.

Figure 12:
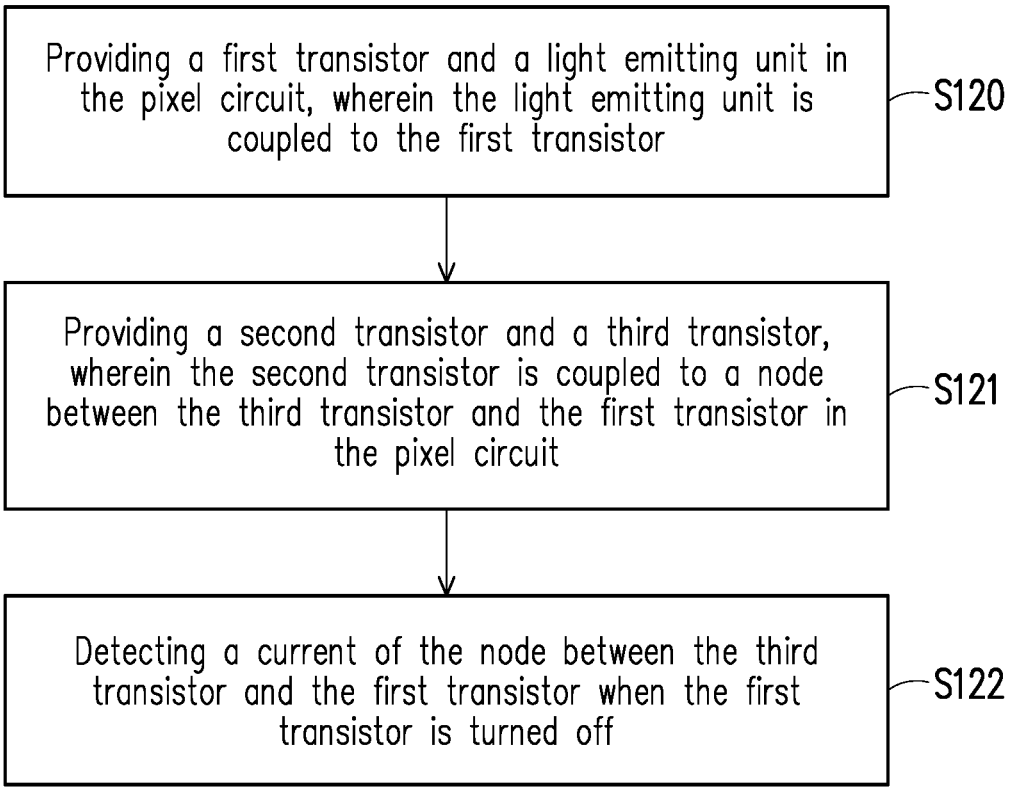
FIG. 12 is a flow chart of a detecting method according to an embodiment of the disclosure.

FIG. 12 is a flow chart of a detecting method according to an embodiment of the disclosure. The operations in the above paragraphs can be summarized as the detecting method illustrated in FIG. 12. The detecting method includes Steps S120-S122. In Step 120, a first transistor Te and a light emitting diode D1 are provided in a pixel circuit 10, wherein the light emitting unit D1 is coupled to the first transistor Te. In Step S121, a switch transistor Tss (i.e. the second transistor) and a driving transistor Td (i.e. the third transistor) are provided in the pixel circuit 10. The switch transistor is coupled to a node Nf between the driving transistor Td and the first transistor Te. In Step S122, a current If of the node Nf between the driving transistor Td and the first transistor Te is detected when the first transistor Te is turned off.

In summary, according to some embodiments, a plurality of lookup tables recording the plurality of relationships between the data voltages and the LED luminances for the plurality of pixel circuits 10 in the display device 1 can be obtained. In this way, the calibration on the LED luminance can be performed based on the detected electrical property (for example, current or voltage) and based on the lookup tables. Thus, luminance non-uniformity or image non-uniformity issues of each pixel circuit can be effectively reduced, and mura effect of the display device can be reduced.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A pixel circuit, comprising:

a first transistor;

a second transistor;

a third transistor; and a light emitting unit, wherein the first transistor, the third transistor, and the light emitting unit are serially connected, and the second transistor is connected to a node between the first transistor and the third transistor, wherein when the first transistor is turned off, a current of the node is detected, wherein the current is detected by a current monitor, the current monitor comprises:

a first sensing transistor, coupled to the second transistor, and receiving a first sensing signal;

a second sensing transistor, coupled to the second transistor, and receiving a second sensing signal;

an operational amplifier, coupled to the first sensing transistor and the second sensing transistor for generating an output signal;

a resistor, connected to the operational amplifier; and a capacitor, coupled to the operational amplifier.

2. The pixel circuit of claim 1, wherein when the first transistor is turned on, a voltage of the node between the third transistor and the first transistor is detected.

3. The pixel circuit of claim 1, comprising:

a fourth transistor, coupled to a data line and receiving a first scan signal, wherein the third transistor is coupled to the node and the fourth transistor, and receives a first reference voltage, the first transistor is coupled to the node, the light emitting unit is coupled to the first transistor and receives a second reference voltage, and the second transistor is coupled to a sense line and the node, and receives a second scan signal.

4. The pixel circuit of claim 1, wherein the current monitor comprises:

a third sensing transistor coupled in parallel to the resistor.

5. The pixel circuit of claim 1, wherein the second transistor is coupled to a data line and the node between the third transistor and the first transistor, the pixel circuit further comprising:

a fourth transistor, coupled to the data line and the third transistor, and receiving a first scan signal.

6. The pixel circuit of claim 5, wherein the current monitor is coupled to the data line for detecting the current of the node between the third transistor and the first transistor, and wherein a preset circuit is coupled to the data line for presetting the data line.

7. The pixel circuit of claim 5, wherein the current monitor is coupled to the data line for detecting the current of the node between the third transistor and the first transistor, the current monitor comprising:

the first sensing transistor, coupled to the second transistor through the data line;

the second sensing transistor, coupled to the second transistor through the data line;

a preset circuit, coupled to the operational amplifier for presetting the data line.

8. The pixel circuit of claim 1, further comprising the current monitor embedded in the pixel circuit, for detecting the current of the node between the third transistor and the first transistor.

9. The pixel circuit of claim 8, further comprising:

a fourth transistor, coupled to a data line and the third transistor, wherein the second transistor is coupled to a sense line and the current monitor, and receives a second scan signal, wherein the current monitor comprises:

the first sensing transistor, coupled to the node;

the second sensing transistor, coupled to the node;

the operational amplifier, coupled to the first sensing transistor, the second sensing transistor, and the second transistor for generating the output signal to the sense line.

10. The pixel circuit of claim 8, further comprising:

a fourth transistor, coupled to a data line and the third transistor, wherein the second transistor is coupled to the data line and the current monitor, and receives a second scan signal, wherein the current monitor comprises:

the first sensing transistor, coupled to the node;

the second sensing transistor, coupled to the node;

the operational amplifier, coupled to the first sensing transistor, the second sensing transistor, and the second transistor for generating the output signal to the data line.

11. The pixel circuit of claim 1, comprising:

a fourth transistor, coupled to a data line, the third transistor and receiving a first scan signal, wherein the third transistor is coupled to the fourth transistor and the node, and receives a first reference voltage, the third transistor is coupled to the node through the light emitting unit, the light emitting unit is coupled to the third transistor and the node, the first transistor is coupled to the node, and receives a second reference voltage and an emission signal, and the second transistor is coupled to the node, and receives a second scan signal.

12. The pixel circuit of claim 1, comprising:

a fourth transistor, coupled to a data line and the third transistor, and receiving a first scan signal, wherein the first transistor is coupled to the node and receives a first reference voltage and an emission signal, the third transistor is coupled to the node and the light emitting unit, the light emitting unit is coupled to the third transistor and receives a second reference voltage, and the second transistor is coupled to the node and receives a second scan signal.

13. A detecting method adapted to detect a pixel circuit, comprising:

providing a first transistor and a light emitting unit in the pixel circuit;

providing a second transistor and a third transistor, wherein the first transistor, the third transistor, and the light emitting unit are serially connected, the second transistor is connected to a node between the third transistor and the first transistor in the pixel circuit; and detecting a current of the node between the third transistor and the first transistor when the first transistor is turned off, wherein the current is detected by a current monitor, the current monitor comprises:

a first sensing transistor, coupled to the second transistor, and receiving a first sensing signal:

a second sensing transistor, coupled to the second transistor, and receiving a second sensing signal;

an operational amplifier, coupled to the first sensing transistor and the second sensing transistor for generating an output signal:

a resistor, connected to the operational amplifier; and a capacitor, coupled to the operational amplifier.

14. The detecting method of claim 13, comprising:

detecting a voltage of the node between the third transistor and the first transistor when the first transistor is turned on.

15. The detecting method of claim 13, wherein the second transistor is coupled to a data line, the first transistor and the node between the third transistor, the detecting method comprising:

providing a fourth transistor coupled between the data line and the third transistor, wherein the fourth transistor is coupled to the data line, the third transistor, and receives a first scan signal.

16. The detecting method of claim 15, comprising:

providing the current monitor coupled to the data line for detecting the current of the node between the third transistor and the first transistor; and providing a preset circuit coupled to the data line for presetting the data line.

17. The detecting method of claim 13, the method comprising:

providing the current monitor in the pixel circuit for detecting the current of the node between the third transistor and the first transistor.

18. A display device, comprising:

a plurality of pixel circuits, at least one of the pluralities of pixel circuits comprising:

a first transistor;

a second transistor;

a third transistor; and a light emitting unit, wherein the first transistor, the third transistor and the light emitting unit are serially connected, and the second transistor is connected to a node between the first transistor and the third transistor, wherein when the first transistor is turned off, a current of the node is detected, wherein the current is detected by a current monitor, the current monitor comprises:

a first sensing transistor, coupled to the second transistor, and receiving a first sensing signal;

a second sensing transistor, coupled to the second transistor, and receiving a second sensing signal;

an operational amplifier, coupled to the first sensing transistor and the second sensing transistor for generating an output signal;

a resistor, connected to the operational amplifier; and a capacitor, coupled to the operational amplifier.

* * * * *